US005094138A

United States Patent [19]

Otsuka et al.

[11] Patent Number: 5,094,138

[45] Date of Patent: Mar. 10, 1992

[54] ELECTRONIC MUSICAL INSTRUMENT

[75] Inventors: Satoshi Otsuka; Minoru Fujisawa, both of Hamamatsu, Japan

[73] Assignee: Roland Corporation, Osaka, Japan

[21] Appl. No.: 602,045

[22] Filed: Oct. 24, 1990

Related U.S. Application Data

[63] Continuation of Ser. No. 321,857, Mar. 10, 1989, abandoned.

[30] Foreign Application Priority Data

Mar. 17, 1988 [JP] Japan ..... 63-62033

[51] Int. Cl.[5] ..... G10H 5/00

[52] U.S. Cl. ..... 84/663; 84/665

[58] Field of Search ..... 84/633, 665, 711, 702, 84/663, 627, DIG. 12, 713, 635, 667

[56] References Cited

U.S. PATENT DOCUMENTS

| | | | |
|---|---|---|---|
| 3,610,799 | 10/1971 | Watson | 84/617 |
| 3,610,806 | 10/1971 | Deutsch | 84/663 |
| 3,848,142 | 11/1974 | Adachi | 307/602 |
| 3,882,751 | 12/1973 | Tomisawa et al. | 84/605 |
| 3,979,989 | 9/1976 | Tomisawa et al. | 84/626 |
| 4,022,098 | 10/1975 | Deutsch | 84/617 |
| 4,114,495 | 9/1978 | Tomisawa | 84/609 |
| 4,119,006 | 10/1978 | Whitefield | 84/663 |
| 4,145,946 | 3/1979 | Deutsch | 84/627 |
| 4,290,334 | 9/1981 | Kramer | 84/702 |
| 4,301,704 | 11/1981 | Nagai et al. | 84/626 |
| 4,520,708 | 6/1985 | Wachi | 84/627 |
| 4,526,080 | 7/1985 | Amano | 84/633 |
| 5,009,147 | 4/1991 | Yamamori | 84/633 |

FOREIGN PATENT DOCUMENTS

| | | | |
|---|---|---|---|
| 932996 | 9/1973 | Canada | 84/627 |
| 0042555A1 | 3/1981 | European Pat. Off. . | |
| 42555 | 12/1981 | European Pat. Off. . | |
| 51-31221 | 3/1976 | Japan . | |
| 57-141695 | 9/1982 | Japan . | |
| 63-38990 | 2/1988 | Japan . | |
| 63-38991 | 2/1988 | Japan . | |

*Primary Examiner*—Geoffrey S. Evans

*Attorney, Agent, or Firm*—Beveridge, DeGrandi & Weilacher

[57] ABSTRACT

A first musical tone to be generated by a musical tone generating channel and a second musical tone which is the same as the first tone and which already has been generated by another musical tone generating channel are both generated in a superposed manner. When the first tone is generated, the volume of either the first tone or the second tone is superimposed on the generated volume of the other musical tone. Also, the volume attributed to the first musical tone due to decay is reproduced by changing the volume of the second musical tone.

19 Claims, 19 Drawing Sheets

ELECTRONIC MUSICAL INSTRUMENT

This application is a continuation, of application Ser. No. 07/321,857 now abandoned, filed Mar. 10, 1990.

BACKGROUND OF THE INVENTION

1. Field of the Invention

The present invention relates to an electronic musical instrument, for example, an electronic keyboard instrument, an electronic drum apparatus a rhythm machine, an automatically performing apparatus, an automatically accompanying apparatus or the like, and in other words, relates to a processing technique for the case where the same musical tones are generated in a superposed manner.

1. Description of Related Art

In the electronic musical instrument as described above, where a first musical tone to be generated is generated so as to be superposed on a second same musical tone which has been already assigned to a musical tone generating channel, the processing has been performed wherein the second same musical tone is simply assigned to a musical tone generating channel different from the musical tone generating channel whereto the first musical tone has been assigned.

Also, the processing has been further performed wherein, following the processing as described above, the first musical tone quickly decays after starting generation of the second same musical tone assigned to the musical tone generating channel.

SUMMARY OF THE INVENTION

In musical instruments of adecaying tone system, a tone is generated by beating a tone generating body (string, film or the like). Accordingly, when the tone generating body which has generated a musical tone generates the same musical tone again in a superposed manner, the previously generated tone is weakened when the tone generating body is beaten again and a newly generated tone is added.

Taking the piano for an example, where consecutive beats are made so as to superpose the same musical tone, a string which is set in vibration by the previous key-press is beaten again by a hammer, and therefore the vibration caused by the previous key-press is damped partly by a contact with the hammer and decays, and energy generated by a new key-press is added.

However, the former as described in Description of Related Art has a problem that the generated volume is increased uselessly.

Then, the latter can solve the problem as described above, but has another problem in that the tone is quickly weakened when the first musical tone having a small generated volume is superposed on the second musical tone having a large generated volume.

An object of the present invention is to eliminate such problems and provide an electronic musical instrument wherein the generated volume does not increase uselessly or decrease suddenly and both musical tones are connected naturally without giving a sense of incongruity when the same musical tone is generated in a superposed manner.

Another object of the present invention is to provide an electronic musical instrument capable of performing a high-fidelity simulation of the generated volume in the case where the same musical tones are generated in a superposed manner.

To achieve the above-described objects, an electronic musical instrument in accordance with the present invention is characterized, as shown in FIG. 1, by comprising:

a first detecting means (1) for detecting whether or not a first musical tone which is assigned to be generated by the musical tone generating channels and a second musical tone which has been already assigned to the musical tone generating channels are the same musical tone, a second detecting means (2) for detecting a generated volume of the first musical tone or a value equivalent to that generated volume and a generated volume of the second musical tone when the first musical tone is to be generated, or a value equivalent to that generated volume, a calculating means (3) for calculating a composite generated volume or a value equivalent to that composite generated volume, based on the generated volume of the first musical tone and the generated volume of the second musical tone when the first musical tone is to be generated, or values equivalent to those generated volumes, which are detected by the second detecting means (2), and a changing means (4), responsive to a detection by the first detecting means (1) that the first and second musical tones are the same musical tone, for changing a generated volume of the musical generating channel whereto either the first musical tone or the second musical tone has been assigned, to the composite generated volume or the value equivalent to that composite generated volume which is calculated by the calculating means (3).

Accordingly, a generated volume of either the first or the second same musical tone which is generated preferentially is changed to the composite generated volume, and a change in volume is reproduced in a manner that a generated volume of the musical tone not generated preferentially is absorbed into the generated volume of the musical tone generated preferentially.

The detecting means (2) may be a detecting means for detecting the generated volume of the first musical tone or the value equivalent to that generated volume and the generated volume of the second musical tone corresponding to the point when the first musical tone is to be generated based on a constituent tone mainly constituting a continuing portion of the musical tone to be generated, to give a feeling of volume.

The changing means (4) may be a changing means for changing an envelope of either the first or second musical tone, whichever is generated preferentially, and thereby changes the generated volume or volume value of the musical tone generated preferentially to the composite generated volume or the value equivalent to the composite generated volume.

Also, to achieve the above-described objects, an electronic musical instrument in accordance with another invention is characterized, as shown in FIG. 1, by comprising a first detecting means (1') for detecting whether or not a first musical tone which is assigned to be generated by the musical tone generating channels and a second musical tone which has been already assigned to the musical tone generating channels are the same musical tone, a second detecting means (2') for detecting a generated volume of the second musical tone when the first musical tone is to be generated, or a value equivalent to that generated volume, a calculating means (3') for calculating a remaining generated volume or a value equivalent to that remaining generated volume, based on the generated volume or the value equivalent to that generated volume, which is detected by the second detecting means (2'), and a changing means (4), responsive to a detection by the first detecting means (1') that the first and the second musical tones are the same musical tone, for changing a generated volume of the musical tone generating channel whereto the second musical tone has been assigned, or a value equivalent to that generated volume, to the remaining generated volume or to the value equivalent to that remaining generated volume which is calculated by the calculating means (3).

Accordingly, the volume generated by the second musical tone is changed and the change in volume caused by decay of the first musical tone is reproduced.

The second detecting means (2') may be a detecting means for detecting the generated volume or the value equivalent to that generated volume, based on a constituent tone mainly constituting a continuing portion of a musical tone to be generated, to give a feeling of volume.

The changing means (4') may be a changing means for changing an envelope of the second musical tone, and to thereby change the generated volume of the second musical tone or the value equivalent to that generated volume to the remaining generated volume or the value equivalent to that remaining generated volume.

The electronic musical instrument may be an electronic keyboard musical instrument, an electronic drum apparatus, a rhythm machine, an automatically performing apparatus, or an automatically accompanying apparatus.

Other objects of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF DRAWINGS

The present invention will become more fully understood from the detailed description given hereinbelow and the accompanying drawings which are given by way of illustration only, and thus are not limitative of the present invention, and wherein:

FIG. 2 to FIG. 15 are drawings for explaining a first embodiment of an electronic musical instrument in accordance with the invention wherein, FIG. 2 is a schematic block diagram;

FIG. 3 is a flow-chart illustrating a basic problem of programs executed by a microcomputer;

FIG. 4 is a touch response data-attack level conversion graph relating to the embodiment;

FIG. 5 and FIG. 6 are flow-charts illustrating a detecting routine of consecutive beats and a changing routine of an envelope which are executed by a microcomputer, respectively;

FIG. 7 and FIG. 8 are waveform graphs showing musical tones envelopes which have been processed based on the flow-charts in FIG. 3, FIG. 5 and FIG. 6, respectively;

FIG. 9 and FIG. 10 show various changed examples of FIG. 8;

FIG. 11 and FIG. 12 are envelope waveform graphs relating to the embodiment, respectively;

FIG. 13 is an envelope waveform graph showing envelopes of a first constituent tone A, a second constituent tone B1 and a second constituent tone B2, relating to modified examples of the embodiment;

FIG. 14 and FIG. 15 are waveform graphs showing musical tone envelopes corresponding to FIG. 7 and FIG. 8 of the embodiment relating to the modified examples, respectively;

FIG. 16 to FIG. 19 are drawings useful for explaining a second embodiment of an electronic musical instrument in accordance with the invention wherein, FIG. 16 is a flow-chart of a detecting routine of consecutive beats of the embodiment;

FIG. 17 is a flow-chart of a changing routine of an envelope of the embodiment; and FIG. 18 and FIG. 19 are an envelope waveform graph of a first constituent tone A' and a second constituent tone B' in a modified example 2 of the embodiment and a touch response data-attack level conversion graph corresponding to FIG. 4 of the first embodiment, respectively.

DETAILED DESCRIPTION OF PREFERRED EMBODIMENTS

Specific embodiments of an electronic musical instrument in accordance with the present invention will be described with reference to the drawings.

Figure 1:
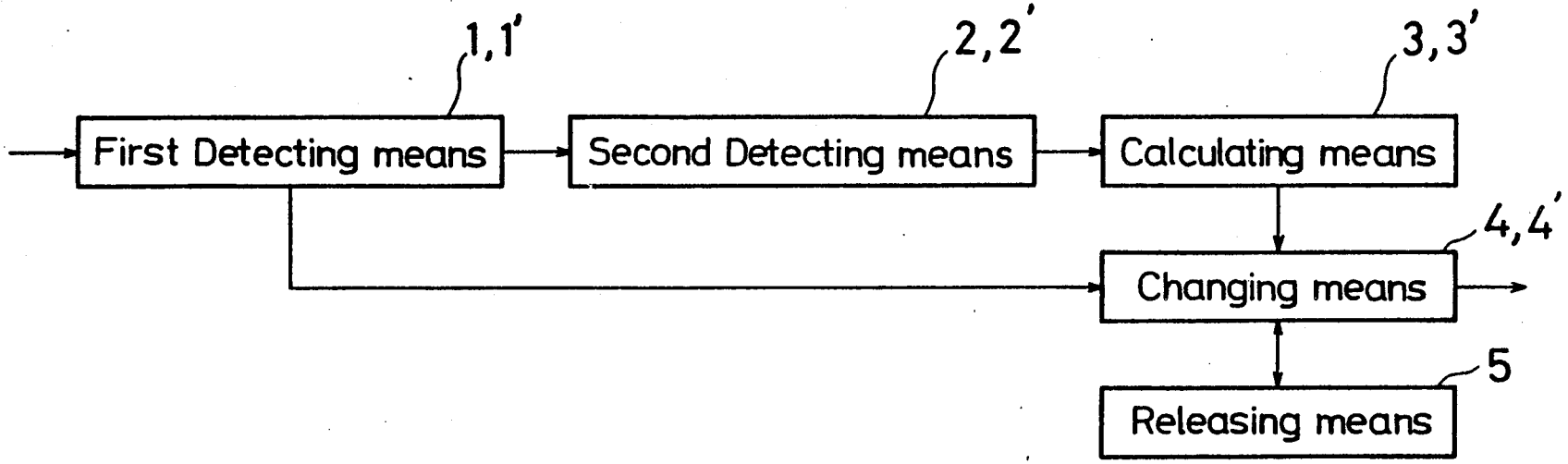
FIG. 1 is a block diagram corresponding to an embodiment of the invention.
Figure 2:
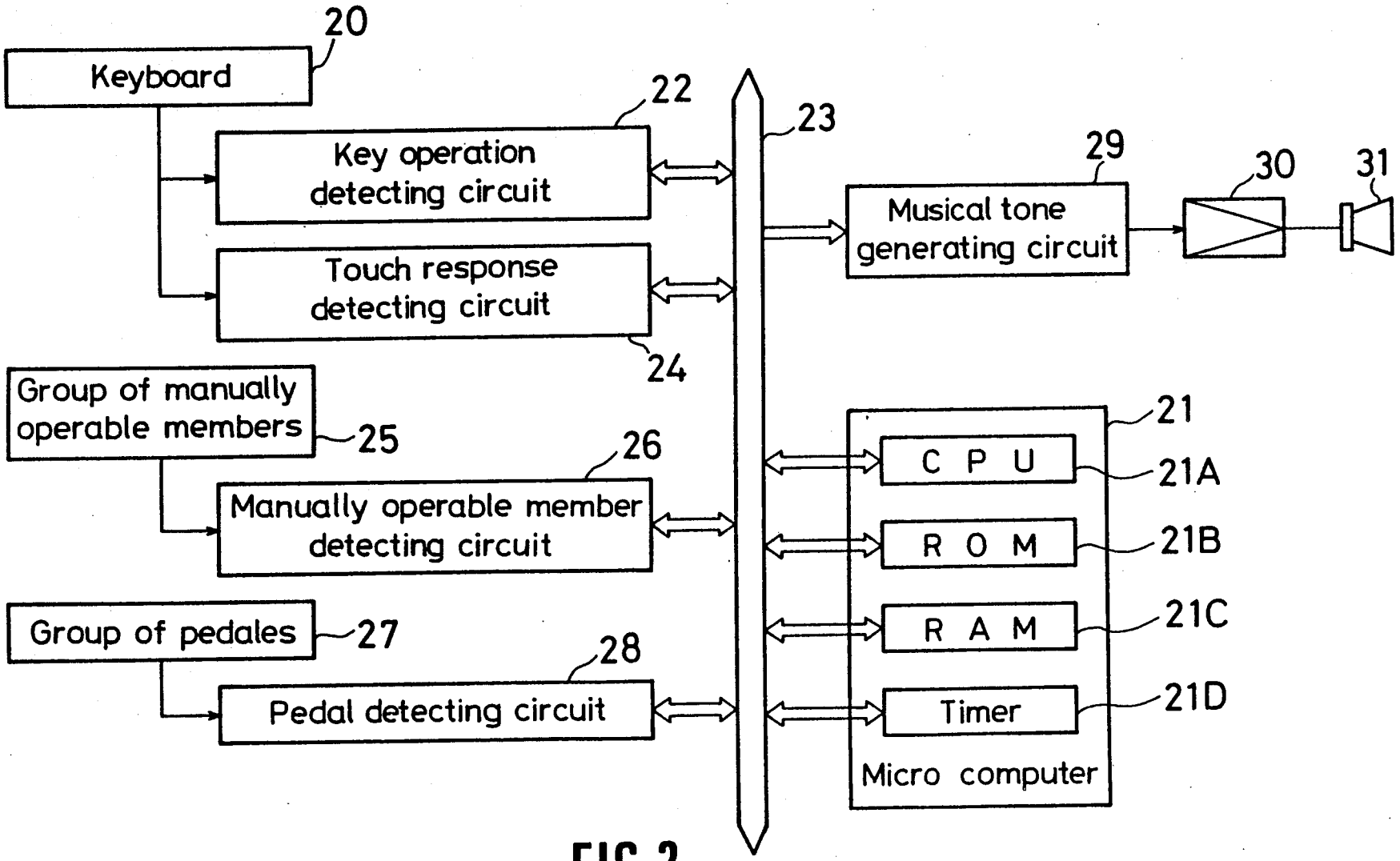

FIG. 2 is a schematic diagram showing an electronic musical instrument for generating musical tones according to a decaying tone system (a percussive system), in other words, an electronic keyboard musical instrument in accordance with the invention. In the FIG. 2, based on key-press or key-off operation of each key on a keyboard 20 constituted with a plurality of keys for specifying the pitches of musical tones generated, under control of a microcomputer 21, a key operation detecting circuit 22 detects an operated key. The detecting circuit 22 further detects the key-pressed state or the key-off state, and stores pitch information showing the pitch of the operated key and key-press/off information representing the key-pressed/off states, in a built-in buffer. Controlled by the microcomputer 21, the stored information is supplied to the microcomputer 21 through a bus 23 as key codes data BKYC, a key state flag BKYS and a total number KEN of changed keys showing the number of keys changed during the storing period. Similarly, the speed of a key-press, the strength of a key touch or the pressure of a key-press and the like based on key operation are detected by a touch response detecting circuit 24, and are stored in a buffer built in the touch response detecting circuit 24 as touch response information. Controlled by the microcomputer 21, the stored data are supplied to the microcomputer 21 through the bus 23 as touch response data BKTD corresponding to the data BKYC, BKYS and the like. Furthermore, the state of operation of a group of manually operable members 25 which change or adjusts the tone quality, for example, of the piano, the harpsichord, the volume generated and the like are detected by a manually operable member detecting circuit 26 and are supplied to the microcomputer 21 as manually operable member data MNPh. Also, operation of a group of pedals 27 comprising damper pedals extend the decay time by inhibiting damping-processing and sostenuto pedals which inhibiting damping-processing while a key is pressed and a sostenuto pedal is depressed and which provides for quick decay of the musical tone through damping-processing when the sostenuto pedal is released after releasing the key, is detected by a pedal detecting circuit 28. A damper state flag FCDS and a sostenuto state flag are supplied to the microcomputer 21. The manually operable member data MNPh and the damper state flag FCDS and the like represent the manually operable member state and the pedaled state at the point of supply to the microcomputer 21. Also, the key code BKYC, key state flag BKYS and touch response datum BKTD constitute key data BKYD.

The detailed description of the sostenuto state flag and the processing relating thereto and the like are left to the known references and the like, and omitted for simplification sake.

The microcomputer 21 is constituted with a central processing unit (CPU)21A executing predetermined programs, a read only memory (ROM)21B storing the programs, a random access memory (RAM)21C as a working memory required for executing the programs and as various registers assigned for storing the manually operable member data MNPh, damper state flag FCDS, key data BKYD and the like, and a timer circuit 21D for measuring the time in the programs. Then, in the embodiment, by executing the programs through the manually operable member data MNPh, damper state flag FCDS, key datum BKYD and the like, a musical tone generating circuit 29 having 32 musical tone generating channels is controlled to generate a desired musical tone signal by a predetermined assigned musical tone generating channel, and musical tones are generated from a speaker 31 through an amplifier 30.

In the embodiment, it is assumed that a musical tone is constituted, like a piano tone, with (a) a first constituent tone A mainly constituting an initial portion (so-called attack part A and decay part D in the ADSR representation) consisting of a hammer tone, and a string-beat having a large quantity of harmonic components immediately after key-press, and (b) a second constituent tone B which mainly constitutes a continuing portion(a sustaining part S and a release part R) following the initial portion consisting of a string tone having a small quantity of harmonic components and a small quantity of changes in the tone quality to give a feeling of volume. Also, in the embodiment, it is assumed that the musical tone signal is generated in a manner that the first constituent tone A and the second constituent tone B are generated by different musical tone generating channels, respectively. In other words, 32 musical tone generating channels from a first channel to a 32nd channel of the musical tone generating circuit 29 are divided into combinations so that the first and the second channels, the third and the fourth channels, . . . the 31st and the 32nd channels generate a desired musical tone, respectively. Then, the first constituent tone A is assigned to an even numbered channel and the second constituent tone B is assigned to an odd numbered channel to generate the musical tone signal.

The basic operation of the electronic musical instrument in accordance with the invention which is constituted as described above will be described in detail in view of a flow-chart in FIG. 3.

A. By turning on the power switch, the basic program is started, and the contents of the RAM21C in the microcomputer 21 which are assigned as various registers are cleared, and the key operation detecting circuit 22, the touch response detecting circuit 24, the manually operable member detecting circuit 26, the pedal detecting circuit 28, and further the musical tone generating circuit 29 are initiated.

B. By means of the manually operable member data MNPh is read from the manually operable member detecting circuit 26, parameters are read from a predetermined table stored in the ROM21B, and are converted into a group of parameters GTEm relating to a musical tone generation, and the group of converted parameters GTEm are written to a predetermined register(s) GTEmR. This register(s) GTEmR is installed in correspondence to each of 32 musical tone generating channels constituting the musical tone generating circuit 29, in other words, in correspondence to each envelope waveform producing channel corresponding to each musical generating channel.

C. The damper state flag FCDS showing the pedaled state of the damper pedal of the group of pedals 27 by "1" is read from the pedal detecting circuit 28, and written to a register FCDSR.

D. The key code BKYC based on the pitch information(s) and the key state flag BKYS showing the key-pressed state by "1" based on the key-press/off information(s) stored in the buffer after the point of the previous read-out from the key operation detecting circuit 22, are read in a time sequence of production, and based on the key-press/off information(s), the total number KEN of the changed keys showing the number of keys having changed after the point of the previous read-out is read.

Likewise, the touch response data BKTD is read from the touch response detecting circuit 24 in a time sequence of production. The key code BKYC, key state flag BKYS and touch response data BKTD make up the key data BKYD in a manner of correspondence to one another as described above, and are written to the corresponding area of the register BKYR in a time sequence of production.

Also, the total number of changed keys KEN is written to a register BKENR as a number of new processing-wait keys BKEN.

E. Whether or not the processing of key operation based on key-press or key-off has been completed is determined according to whether or not the number of processing-wait keys BKEN written to the register BKENR is "0". Where the number of processing-wait keys BKEN is "1" or more and the processing of key operation has not been completed, go to Step G.

F. When the number of processing-wait keys BKEN is "0" in the decision in Step E and the processing of key operation has been completed, a predetermined envelope processing is performed sequentially as follows in each envelope waveform producing channel.

Figure 4:
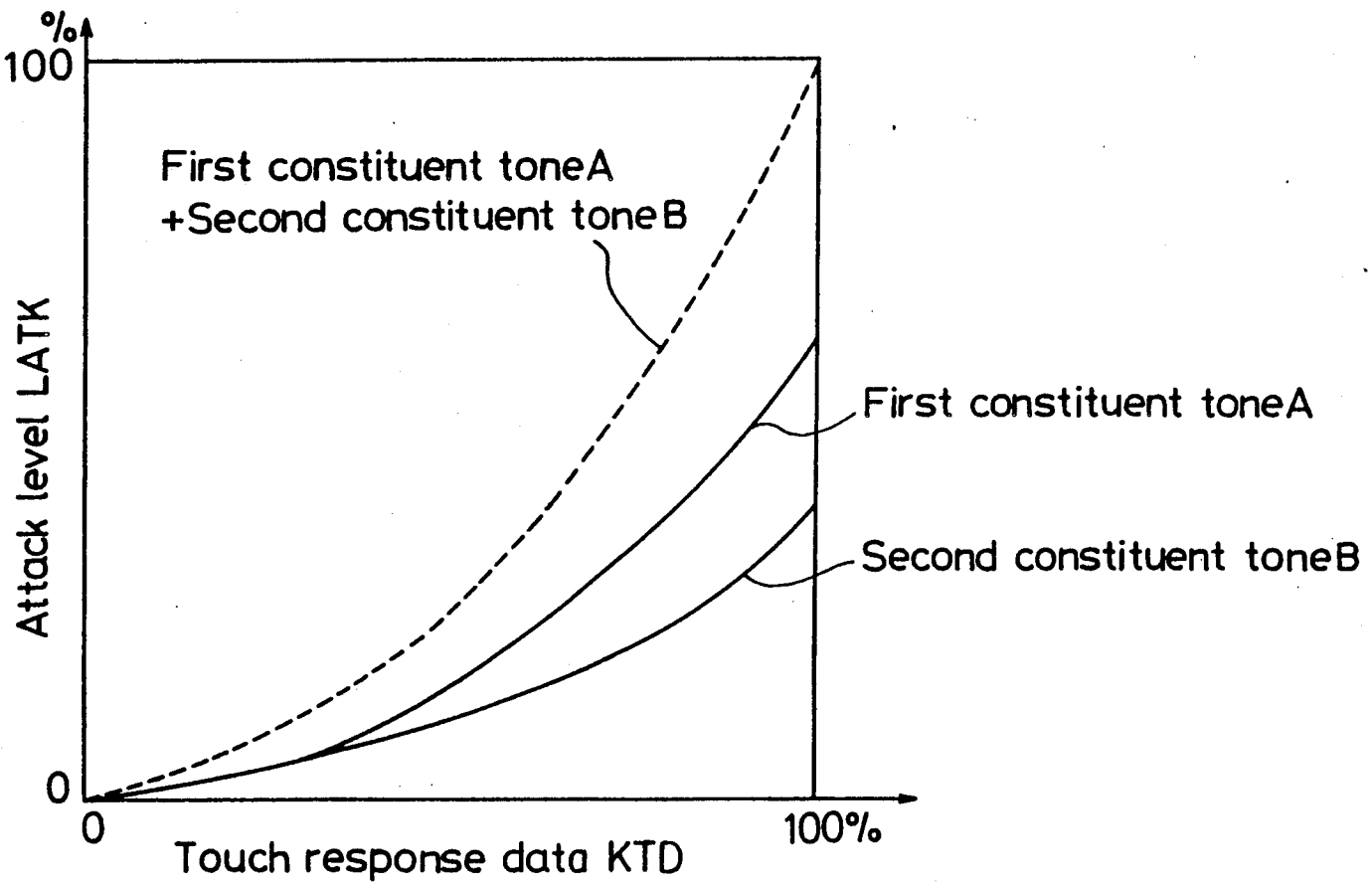

(I) A predetermined table of envelope waveforms stored in the ROM21B is read, and based on the group of parameters GTEm relating to musical tone generation written to the corresponding register GTEmR, and further a key code KYC written to the similarly corresponding registers KYCR and KTDR and a touch response datum KTD as described later, a group of rates RTj and a group of break point levels LBPj are calculated and produced which are constituted with a rate RT showing a value of change of envelope per a predetermined time (including a plus or minus sign according to an increase or decay of the envelope) and a break point level LBP showing the envelope level at the point of change of the accumulated rate RT, in other words, at the point of change of inclination of the envelope, respectively. Also, from the group of parameters GTEm relating to musical tone generation, a first changing rate RTS showing a negative value of change per a predetermined time and a second changing rate RTA showing a positive value of change per a predetermined time in changing the envelope, are calculated and produced. Furthermore, an attack level LATK is produced by the conversion table stored in advance in the ROM21B in correspondence to a touch response datum KTD-attack level LATK conversion graph as shown in FIG. 4 (hereinafter, the group of rates RTj, group of break point levels LBPj, first changing rate RTS, second changing rate RTA and attack level LATK are referred to as "envelope parameters").

II) Based on the calculated predetermined group of rates RTj and group of break point levels LBPj, an envelope level LEV is calculated, in other words, an envelope waveform is calculated. Calculation of the envelope level LEV is performed as follows. A portion corresponding to an envelope step j written to a register jR in the group of break point levels LBPj written to a register LBPjR is written to a register LBPR, and a portion corresponding to the envelope step j written to the register jR in the group of rates RTj written to a register RTjR is written to a register RTR. Subsequently, the rate RT written to the register RTR is accumulated on the envelope level LEV, and when this accumulated value reaches the break point level LBP written to the register LBPR, 1 is added to the envelope step j, and the number after the addition is written to the register jR as a new envelope step j, and so on. This procedure is performed repeatedly.)

III) In the envelope waveform produced as described in the preceding item, when the attack part A in the so-called ADSR representation is completed (this fact is decided by whether or not the envelope level LEV has reached a break point level LBP"-AT"(attack level LATK) corresponding to completion of the attack part A), an attack end flag EV"-AT" is set to "0", and when the release part R is completed (this fact is decided by whether or not the envelope level LEV has reached a break point level LBP"-END" corresponding to completion of the release part R), an envelope end flag EV"-END" is set to "0". By the "0" of the envelope end flag EV"-END", the corresponding musical tone generating channel is released.

(These group of rate RTj, group of break point level LBPj, first changing rate RTS, second changing rate RTA, attack level LATK, and the rate RT, breakpoint level LBP, envelope level LEV and envelope step j which are to be calculated, and the various flags EV"-AT" and EV"-END" including a muting processing request flag DMPQ and a muting in-processing flag RDMP as described later are installed in a manner of corresponding to each envelope waveform producing channel. Accordingly, the registers RTjR, LBPjR, RTSR, RTAR, RTR, LBPR, LEVR, jR, EV-ATR, EV-ENDR, DMPQR and RDMPR to or from which those data are written or read are installed on an envelope waveform producing channel basis. Then, these registers constitute one group on an envelope waveform producing channel basis and hereafter are handled as one group.)

Where an in-processing flag RKOF of the key-off envelope to be written to a register RKOFR is set to "1" and a key-off processing (Step M) as described later is started, when the damper state flag FCDS written to the register FCDSR is set to "0" showing that the damper pedal of the group of pedals 27 is not in the pedaled state, the attack end flag EV"-AT" written to the corresponding register EV-ATR is set to "0" showing completion of the attack part A, and thereafter the key-off envelope in-processing flag RKOF is reset to "0", and thereby the envelope waveform is changed to a predetermined key-off envelope. Furthermore, where the muting processing request flag DMPQ written to the corresponding register DMPQR is set to "1" showing request for a muting processing, this muting processing request flag DMPQ is reset to "0", and to give a feeling of attack by generating tones characterizing the attack, a change to a predetermined muting envelope is performed after the attack end flag EV"-AT" has shown completion of the attack part A likewise. The methods of producing those key-off envelope and muting envelope are in accordance with the above-described producing methods.

After an envelope processing, return to Step B.

G. Where the number of the processing-wait keys BKEN is "1" or more and a processing of key operation has not been completed in the decision in Step E, the oldest key data BKYD among the key datum BKYD written to the register BKYR is read (first-in first-out method), and a decision is made on whether or not the key corresponding to the key data BKYD by the key state flag BKYS comprised in the key data BKYD read is in the pressed state. When the key state flag BKYS shows "0" and the key is not in the pressed state but in the off-state, go to Step M.

H. Where the key state flag BKYS shows "1" and the key is in the pressed state in the decision in Step G, "1" is subtracted from the number of processing-wait keys BKEN written to the register BKENR, and the number after the subtraction is written to the register BKENR as a new number of processing-wait keys BKEN.

Figure 5:
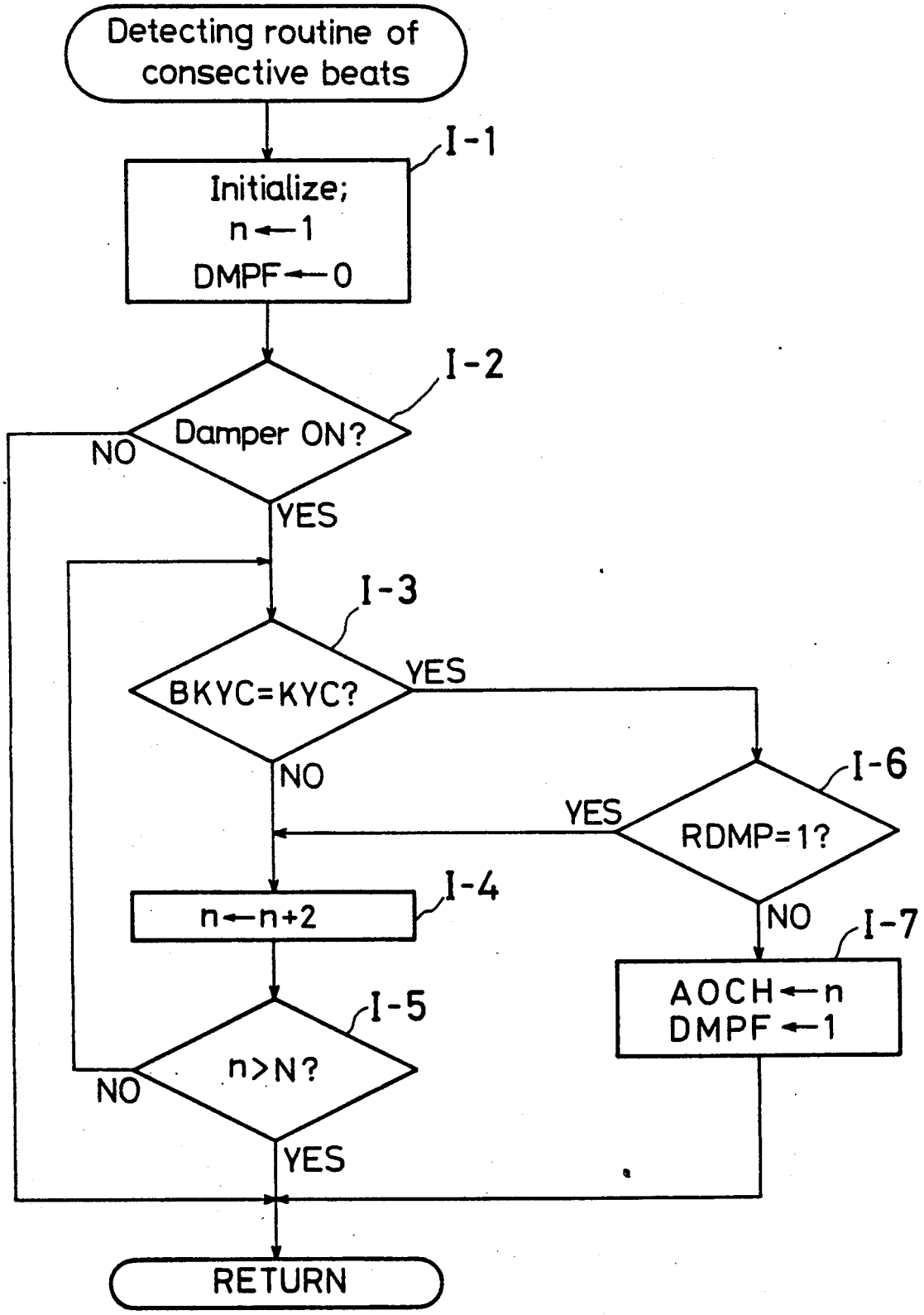

I. Detecting routine of consecutive beats. This detecting routine of consecutive beats will be described later in detail based on a flow-chart as shown in FIG. 5.

J. By deciding whether or not a changing processing start flag DMPF written to a register DMPFR is set to "1" showing start of changing processing, consecutive beats is decided. When the changing processing start flag DMPF is set to "0" and no start of changing processing is shown and no consecutive beats are performed, go to Step L.

K. Where the changing processing start flag DMPH is set to "1" showing start of changing processing and consecutive beats are performed in the decision in Step J, proceed to a changing routine of an envelope. This changing routine of an envelope will be described later in detail based on a flow-chart as described in FIG. 6.

After completion of the envelope changing routine, return to Step E.

L. Where the changing processing start flag DMPF is set to "0" and start of changing processing is not shown and no consecutive beats are performed in the decision in Step J, "1" is subtracted from the number of processing-wait keys BKEN written to the register BKENR, and the number after the subtraction is written to the register BKENR as a new number of processing-wait keys BKENR.

(Assignment of musical tones is performed in a manner that the key code BKYC, the key state flag BKYS set to "1" and the touch response data BKTD of the predetermined key data BKYD read from the register BKYR, are written as the key code KYC, key state flag KYS and touch response data KTD of the key data KYD respectively to the registers KYCR, KYSR and KTDR corresponding to the key code KYC, the key state flag KYS and the touch response data KTD among the key code KYC, the key state flag KYS, the touch response data KTD and the pitch data FQY which are installed for each musical tone assignment channel installed in correspondence to each musical tone generating channel, and further the pitch data FQY which has been calculated and produced by the group of parameters GTEm relating to musical tone generation written to the corresponding register GTEm and the key code KYC written to the register KYCR is written to a register FQYR. Furthermore, in correspondence to the corresponding envelope waveform producing channel, the muting processing request flag DMPQ, muting in-processing flag RDMP and key-off envelope in-processing flag RKOF are reset to "0", and are written to the predetermined registers DMPQR, RDMPR and RKOFR, and the register jR whereto the envelope step j is written and the register LEVR whereto the envelope level LEV is written are cleared. Also, the group of rates RTj, group of break points LBPj, first changing rate RTS, second changing rate RTA and attack level LATK are written to the registers RTjR, LBPjR, RTSR, RTAR and LATKR, and the various flags of the resisters EV-ATR and EV-ENDR are set to "1".)

Assignment of the musical tone generating channel, in other words, to the musical tone assignment channel is performed as follows in combination such as the first and the second channels, the third and the fourth channels, . . . or the 31st and the 32nd channels as is the case with the musical tone generating channel.

I) A combination of musical tone generating channels which has completed tone generation and is released is detected from the key state flag KYS written to the register KYSR of each musical tone assignment channel and the envelope end flag EV"-END" written to the register EV-ENDR of each envelope waveform producing channel, and is assigned as described above, and the tone generation is directed to start. A timer TST counting from musical tone assignment written to a register TSTR installed corresponding to the respective musical tone assignment channel is reset. Next, return to Step E.

II) Where no released combination of musical tone generating channels is detected, based on the envelope level LEV written to the respective registers LEV and EV-ATR of the envelope waveform generating channel corresponding to each second constituent tone B and the attack end flag EV"-AT" of each first constituent tone A and each constituent tone B, the combination of musical tone generating channels which is generating a tone and has completed the attack part A and whose envelope level LEV is lowest is detected. Then, assignment is performed as described above, and the tone generation is directed to start. Furthermore, the timer TST counting from the musical tone assignment is reset. Next, return to Step E. In addition, in this case, a processing of stopping tone generation is performed by resetting the register LEVR, but it is desirable to apply a quick decay processing.

M. Where the key state flag BKYS is set to "0" showing the key-off state wherein the key is not pressed in the decision in Step G, "1" is subtracted from the number of processing-wait keys BKEN written to the register BKENR, and the number after the subtraction is written to the register BKENR as a new number of processing-wait keys BKEN.

By the key code BKYC comprised in the key data BKYD written to the register BKYR, the musical tone assignment channel is detected wherein in the key code KYC and the key state flag KYS written to the respective registers KTCR and KYSR in each musical tone assignment channel, the key codes BKYC and KYC are the same and the key state flag KYS is set to "1" showing the key is in the pressed state, and the key-off envelope in-processing flag RKOF is set to "1" showing that a key-off envelope processing is being processed, the key state flag KYS is changed to "0" showing the key-off state, the key-off processing is directed to start. Next, return to Step E.

Where the musical tone generating channel as described above is not detected, return intact to Step E.

The detecting routine of consecutive beats (Step I) will be described in detail on a step basis in reference to FIG. 5. A detection of consecutive beats wherein the same musical tone is generated in a superposed manner is performed by searching for the musical tone generating channel which is generating an effective tone of the same key based on the second constituent tone B.

I-1. The number of loops n written to a register nR is initialized to "1", and the muting processing start flag DMPF written to the register DMPFR is initialized to "0" indicating no muting processing.

I-2. By the damper state flag FCDS written to the register FCDSR, decision is made on whether or not the damper pedal of the group of pedals 27 is pedaled and a damping processing is inhibited even when the key is released. Where the damper pedal is not in the pedaled state, the damper state flag FCDS shows "0" and a damping processing is not inhibited, the generated tone continuing time in the musical tone generating channel whereto a damping processing is to be applied is short, and there is no fear of causing trouble even if a special processing is not performed, and therefore the routine is ended.

I-3. Where the damper state flag FCDS shows "1" and a damping processing is inhibited in the decision in Step I-2 decision is made on whether or not the key code BKYC of a new key-press of the same key newly pressed (hereinafter referred to as "new key-press") which is in suitable consecutive beats which is written to the register BKYCR and the key code KYC written to the register KYCR of the musical tone generating channel of the channel number corresponding to the number of loops n written to the register nR are the same. Where the key code BKYC of the new key-press and the key code KYC are the same, go to Step I-6.

I-4. Where the key code BKYC of the new key-press and the key code KYC are not the same in the decision in Step I-3, "2" is added to the number of loops n, and the number after the addition is written to the register nR as the new number of loops n.

I-5. The number of musical tone generating channels N being 32 in the embodiment which is stored in the ROM21B is compared with the number of loops n written to the register nR, and if the number of loops n is not larger, return to Step I-3 in a repeated manner, and if the number of loops n is larger, no consecutive beats exist corresponding to all musical tone generating channels, and therefore the routine is ended.

I-6. Where the key code BKYC of the new key-press and the key code KYC are the same in the decision in Step I-3, decision is made on whether or not the muting in-processing flag RDMP written to the register RDMPR of the musical tone assignment channel for the musical tone generating channel of the channel number corresponding to the number of loops n is "1" showing that muting processing is being performed. Where the muting in-processing flag RDMP shows "1" and the muting processing is being performed, because the muting processing has been performed for a consecutive beats processing of the same key by the previous consecutive beats detection, go to Step I-4 to search for the others. In addition, where a quick decay processing in item II is performed in the assignment to the musical tone generating channel in the key-press processing of Step L, when the quick decay processing is being performed, the processing is performed likewise.

I-7. Where the muting in-processing flag RDMP shows "0" and the muting processing is not being performed in the decision in Step I-6, it is assumed to be the old key-press of the same key pressed previously (hereinafter referred to as "old key-press") which is in a suitable consecutive beats relation, and the number of loops n representing the channel number of the old key-press is written to a register AOCHR as a channel number AOCH of the old key-press. Also, the changing processing start flag DMPF is set to "1" showing start of changing processing, being written to the register DMPFR.

In the detecting routine of consecutive beats, in short, the same key has been already assigned to any of the musical tone generating channels based on the second constituent tone B, and the musical tone generating channel generating an effective tone is searched, and the channel number of that musical tone generating channel is written to the register AOCHR, and the changing processing start flag DMPF is set to "1" showing a change start processing. Accordingly, the musical tone generating channel is excluded wherein, even if the same key, the generated tone continuing time is short and start of muting processing has been already directed in a consecutive beats processing. In addition, as described above, detection of consecutive beats is performed on a new key-press basis, and therefore the musical tone generating channel generating an effective tone takes place only by one at a maximum.

The changing routine of an envelope (Step K) will be described in detail on a step basis in reference to FIG. 6. In addition, the musical tone generating channel whereto the second constituent tone B of the old key to be processed in that changing routine of an envelope (Step K) is assigned is the musical tone generating channel of the channel number of the old key-press which is detected in the detecting routine of consecutive beats (Step I) and written to the register AOCHR. In other words, the registers relating to the second constituent tone B of the old key-press used for the following processing are the registers and the like corresponding to the musical tone generating channel of the channel number of the old key-press written to the register AOCHR.

K- 1. Decision is made on whether or not the changing processing start flag DMPF written to the register DMPFR is set to "1" showing the start of changing processing. Where the changing processing start flag DMPF shows "1" and a changing processing is not started, the routine is ended.

K- 2. Where the changing processing start flag DMPF shows "1" and the changing processing is started in the decision in Step K-1, assuming that a new key-press has generated a tone, the envelope waveform of the second constituent tone B is simulated, and the generated volumes WNL and WOL of the second constituent tones B of the new key-press and the old key-press are calculated as follows, and the composite generated volume WSL of the second constituent tone B is calculated. In addition, a simulation of the envelope waveform is performed in a manner that, based on the key code BKYC(KYC), touch response data BKTD (KTD) and manually operable member data MNPh from the table in the ROM21B, the envelope parameters required for producing a predetermined envelope waveform are calculated and produced, and a producing operation of the envelope waveform is simulated at a high speed.

1) Generated volume WNL of the second constituted tone B to be generated by a new key-press.

The envelope waveform of the second constituent tone B of a new key-press is simulated, and the envelope level LEV(t) at a point t=T1 when the envelope waveform completes the attack part A is evaluated, and this envelope level LEV(t) is written to a register WNLR as the generated volume of the second constituent tone B of the new key-press.

$$WNL = LEV(t),\ t = T1$$

Since the envelope level LEV(t), t=T1 is the same as the attack level LATK, the attack level LATK may be used in place thereof.

2) Generated volume WOL of the second constituent tone B to be generated by the old key press.

Similar simulation is performed, and the second constituent tone B of the old key-press at a point t=T1+T2 when the envelope waveform of the second constituent tone B of the new key-press completes the attack part A, in other words, the envelope level LEV(t) of the musical tone generation channel of the channel number AOCH of the old key-press written to the register AOCHR is evaluated, and this envelope level LEV(t) is written to a register WOLR as the generated volume WOL of the second constituent tone B of the old key-press.

$$WOL = LEV(t),\ t = T1 + T2$$

The current value of the envelope level LEV of the second constituent tone B of the old key-press written to the register LEVR' may be used as an approximate processing in place of the envelope level LEV(t). In this case, if the envelope waveform of the second constituent tone B of the old key-press has not completed the attack part A, the attack level LATK of the second constituent tone B is used in place of the envelope level LEV(t).

T1 A time from musical tone assignment of a new key-press to completion of the attack part A by the envelope waveform of the second constituent tone B T2 A time from musical tone assignment of the old key-press to musical tone assignment of a new key-press.

(The time T1 is evaluated by simulating the envelope waveform of the second constituent tone B, and the time T2 is obtained by reading the current value of the timer TST counted from the assignment which has been written to the corresponding register TSTR, showing the time lapse from the musical tone assignment of the old key-press.)

3) Composite generated volume WSL of the second constituent tone B Since energy of the old key-press is partly lost at a new key-press, the generated volume of the second constituent tone B of the old key-press after the new key-press (remaining generated volume) is decreased to a value of the generated volume WOL of the second constituent tone B of the old key-press multiplied by the remaining factor KD. Accordingly, the remaining generated volume evaluated by multiplying the generated volume WOL of the second constituent tone B of the old key-press by the remaining factor KD and the generated volume WNL of the second constituent tone B of the new key-press are squared respectively and added, and thereafter its square root is extracted, and thus the composite generated volume WSL of the second constituent tones B is evaluated.

$$WSL = \sqrt{(KD \times WOL)^2 + (WNL)^2}$$

The remaining factor KD differs depending upon the way of beating the tone generating body, the liability of the tone generating body being damped, the strength of beat and the like, namely, the key code BKYC(KYC), touch response data BKTD(KTD) and manually operable member data MNPh. For exmple, in the case of a piano, a hammer strikes strongly against a string at a strong key-press, and weakly touches it at a weak key-press, and therefore the remaining factor KD differs depending upon the strength of touch (key-press). Also, the liability of the string being damped differs depending on the tone-pitch of the string. In other words, though the remaining factor KD differs depending upon the tone pitch, owing to the measures to prevent the string from generating an unclear tone, for example, the the roundness of the head of the hammer of the high-pitch tone part is made smaller in comparison with that of the hammer of the low-pitch tone part so that the time of contact of the hammer with the string does not become longer than required, and a felt covering the head of the hammer of the high-pitch tone part is made thinner than that of the low-pitch tone part, and so on, the change in the remaining factor KD is reduced. Furthermore, in the low-pitch tone region, the vibrating state of the string can not be neglected relative to the movement of the hammer, and a so-called meeting beat off setting the movement of the string takes place, and therefore the remaining factor KD may be changed by the tone pitch and the interval of key-press, or to make the mechanism simple, random elements can be added. Also, since the effect given differs depending upon the degree of higher harmonics, the remaining factor KD may be changed on a constituent tone basis when the constitution is made with a large number of constituent tones. Furthermore, where the tone qualities of various musical instruments can be generated, the remaining factor KD may be changed responding to the characteristics of the musical instrument, in other words, responding to the tone quality.

In the embodiment, to simplify the processing, assuming a fixed decrease of 10%, KD=0.9 is set.

K- 3. Decision is made on whether or not the generated volume WNL of the second constituent tone B of the new key-press written to the register WNR is larger than the generated volume WOL of the second constituent tone B of the old key-press written to the register WOLR. Where the generated volume WNL of the second constituent tone B of the new key-press is not larger than the generated volume WOL of the second constituent tone B of the old key-press, go to Step K-5.

It is also possible to use the remaining generated volume WEL of the second constituent tone B of the old key-press after the new key-press in a second embodiment as described later in place of the generated volume WOL of the second constituent tone B of the old key-press.

K- 4. Where the generated volume WEL of the second constituent tone B of the new key-press is larger than the generated volume WOL of the second constituent tone B of the old key-press in the decision in Step K-3, a processing of preferentially generating the tone of the new key-press is performed, and the envelope of the second constituent tone B of the new key-press is made to correspond to the composite generated volume WSL of the second constituent tone B. In other words, assignment to the musical tone generating channel and the like performed in Step L is performed for the new key-press, and calculation of envelope parameters of the second constituent tone B is performed as follows based on the touch response data WKTD of the second constituent tone B of the new key-press after changing.

1) Where the generated volume of the second constituent tone B of the new key-press after changing is taken as the composite generated volume WSL, the attack level WATK of the second constituent tone B of the new key-press after changing is assumed to be equal to the composite generated volume WSL of the second constituent tone B.

$$WATK = WSL$$

Where the attack level WATK of the second constituent tone B of the new key-press exceeds a maximum value LATK max. of the attack level, assume $$WATK = LATKmax.$$

2) Touch response data WKTD of the second constituent tone B of the new key-press after changing.

The touch response datum WKTD of the second constituent tone B of the new key-press after changing is obtained by converting the attack level WATK of the second constituent tone B of the new key-press after changing on using the inverse conversion table thereof stored in advance in the ROM21B in correspondence to the touch response datum KTD-attack level LATK conversion graph.

3) Assignment to the musical tone generating channel.

Assignment to the musical tone generating channel and the like performed in Step L is performed for the new key-press, and a muting processing of the old key-press is performed.

Then, in calculating and producing the envelope parameters of the second constituent tone B in the case of assignment to the new key-press, the touch response data WKTD of the second constituent tone B of the new key-press after changing obtained in the above-mentioned 2) is used in place of the touch response data BKTD.

Also, muting of the old key-press is performed in a manner that the channel number AOCH of the old key-press written to the register AOCHR is written to a register WDCHR as a number WDCH of the channel to be muting-processed, and the muting processing request flag DMPQ and the muting in-processing flag RDMP of the envelope waveform producing channel corresponding to the channel number WDCH of muting processing to be performed which has been written to the register WDCHR are set to "1" showing request for a muting processing or muting in-processing. In addition, it is also possible that preferential assignment is made to the musical tone generating channel whereto the old key-press has been assigned, or preferential assignment is made to the musical tone generating channel of the old key only when no released musical tone channel exists. Furthermore, it is unnecessary to perform a muting processing of the first constituent tone A.

K- 5. Where the generated volume WNL of the second constituent tone B of the new key-press is not larger than the generated volume WOL of the second constituent tone B of the old key-press in the decision of Step K-3, a processing of preferentially generating the tone of the old key-press and a processing of making the envelope of the second constituent tone B of the old key-press correspond to the composite generated volume WSL are performed in Step K-5 to Step K-19.

First, in this Step K-5, the envelope level WLEV of the second constituent tone B of the old key after changing is calculated and written to a register WLEVR. Where the generated volume of the second constituent tone B of the old key-press after changing is taken as the composite generated volume WSL, the envelope level WLEV of the second constituent tone B of the old key-press after changing is assumed to be equal to the composite generated volume WSL of the second constituted tone B.

$$WLEV = WSL$$

Where the envelope level WLEV of the second constituent tone B of the old key-pres exceeds the maximum value LATKmax. of the attack level, assume $$WLEV = LATKmax.$$

K- 6. Decision is made on whether or not the envelope level WLEV of the second constituent tone B of the old key-press after changing written to the register WLEVR is larger than the attack level LATK of the second constituent tone B of the old key-press written to a register LATKR. Where the envelope level WLEV of the second constituent tone B of the old key-press after changing is not larger than the attack level LATK of the second constituent tone B of the old key-press, go to Step K-11.

K- 7. Where the envelope level WLEV of the second constituent tone B of the old key-press after changing is larger than the attack level LATK of the second constituent tone B of the old key-press in the decision in Step K-6, the touch response data WKTD of the second constituent tone B of the old key-press after changing is calculated in accordance with Step K-4, and based on the touch response datum WKTD, envelope parameters are calculated to be produced. Furthermore, the register jR whereto the envelope step J is to be written is cleared.

K- 8. Decision is made on whether or not the envelope level LEV of the second constituent tone B of the old key-press read from the corresponding register LEVR is larger than the predetermined break point level LBPj written to the register LBPjR corresponding to the envelope Step j written to the register jR. Where the envelope level LEV of the second constituent tone B of the old key-press is not larger than the predetermined break point level LBPj corresponding to the envelope step j, go to Step K-10.

K- 9. Where the envelope level LEV of the second constituent tone B of the old key-press is larger than the break point level LBPj corresponding to the envelope step j in the decision in Step K-8, 1 is added to the envelope step j, and the number after the addition is written to the register jR as a new envelope step j. Next, return to Step K-8.

K-10. Where the envelope level LEV of the second constituent tone B of the old key-press is not larger than the predetermined break point level LBPj corresponding to the envelope step j in the decision in Step K-8, this break point level LBPj is written to the register LBPR, the rate RTj is written to the register RTR, and the attack end flag EV"-AT" is set to "1". Next, go to Step K-19.

K-11. Where the envelope level WLEV of the second constituent tone B of the old key-press after changing is not larger than the attack level LATK of the second constituent tone B of the old key-press in the decision in Step K-6, decision is made on whether or not the envelope level WLEV of the second constituent tone B of the old key-press after changing written to the register WLEVR is larger than the envelope level LEV of the second constituent tone B written to the register LEVR. Where the envelope level WLEV of the second constituent tone B of the old key-press after changing is not larger than the envelope level LEV of the second constituent tone B, go to Step K-14.

K-12. Where the envelope level WLEV of the second constituent tone B of the old key-press after changing is larger than the envelope level LEV of the second constituent tone B in the decision in Step K-11, decision is made on whether or not the envelope waveform of the second constituent tone B of the old key-press has completed the attack part A. Where the attack end flag EV"-AT" shows "1" and the envelope waveform of the second constituent tone B of the old key-press has not completed the attack part A, return to Step K-7.

K-13 Where the attack end flag EV"-AT" shows "0" and the attack part A has been completed in the decision in Step K-12, the second changing rate RTA having a positive value is written to the register RTR as the rate RT, and the envelope level WLEV of the second constituent tone B of the old key-press after changing is written to a register LATKR as the attack level LATK, and the attack end flag EV"-AT" is set to "1". Next, go to Step K-15.

K-14. Where the envelope level LEV of the second constituent tone B of the old key-press after changing is not larger than the envelope level LEV of the second constituent tone B in the decision in Step K-11, the first changing rate RTS having a negative value is written to the register RTR as the rate RT, and the attack end flag EV"-AT" is set to "0".

K-15. The final envelope step j of the attack part A corresponding to the predetermined break point level LBPj equal to the attack level LATK is written to the register jR.

K-16. Decision is made on whether or not the envelope level WLEV of the second constituent tone B of the old key-press after changing written to the register WLEVR is larger than the predetermined break point level LBPj corresponding to the envelope step j written to the register jR. Where the envelope level WLEV of the second constituent tone B of the old key-press after changing is larger than the predetermined break point level LBPj written to the register LBPjR corresponding to the envelope step j, go to Step K-18.

K-17. Where the envelope level WLEV of the second constituent tone B of the old key-press after changing is not larger than the predetermined break point level LBPj corresponding to the envelope step j in the decision in Step K-16, 1 is added to the envelope step j, and the number after the addition is written to the register jR as a new envelope step j. Next, return to Step K-16.

K-18. Where the envelope level WLEV of the old key-press after changing is larger than the predetermined break point level LBPj corresponding to the envelope step j in the decision in Step K-16, 1 is substracted from the envelope step j, and the number after the subtraction is written to the register jR as a new envelope step j, and the envelope level WLEV of the second constituent tone B of the old key-press after changing is written to the register LBPR.

K-19. Assignment to the musical tone generating channel and the like performed in the above-described Step L is performed for the new key-press.

Since generation of the second constituent tone B of the new key-press becomes unnecessary, the second constituent tone B of the new key-press is not generated. In other words, all of the contents of the registers RTjR, LBPjR, EV-ATR, EV-DKR and EV-END corresponding to a channel number ANCH of the new key-press written to a register ANCHR are cleared. Also, assignment to the musical tone generating channel whereto the old key-press is assigned may be inhibited.

The above-described changing routine of the envelope is such that, in short, assuming that a new key-press has generated a tone, the envelope waveform of the second constituent tone B is simulated, the generated volumes WNL and WOL of the second constituent tones B of the new key-press and the old key-press are calculated, the composite generated volume WSL of the second constituent tone B is calculated, and the envelope of the key-press generating the greater volume of WNL and WOL of the second constituent tone B is preferentially changed, and the musical tone generating channel whereto the key-press generating the smaller volume of WNL and WOL of the second constituent tone B is assigned is released.

Accordingly, in short, basically, detection of consecutive beats is performed by searching for the musical tone generating channel generating an effective tone of the same key based on the second constituent tone B, and a preferential processing of tone generation and a changing processing of the envelope are performed, that is, the old key-press or the new key-press generating greater volume is preferentially processed and the envelope thereof is changed, and the musical tone generating channel whereto the key-press generating smaller volume is assigned is released.

In the embodiment, to avoid complication of description, the values set in advance are used for the first changing rate RTS and the second changing rate RTA, but it is desirable to make calculation and setting so that the envelope reaches the next break point LBP after T1 (refer to Step K-2).

Also, if the tone quality of the second constituent tone B is set so that the changing in tone quality made by the touch response datum KTD can be neglected, or to simplify the processing, preferential tone generation by the old (or new) key-press in a fixed manner may be performed without performing a processing of deciding which of the new and old key-presses is to preferentially generate a tone.

Figure 7:
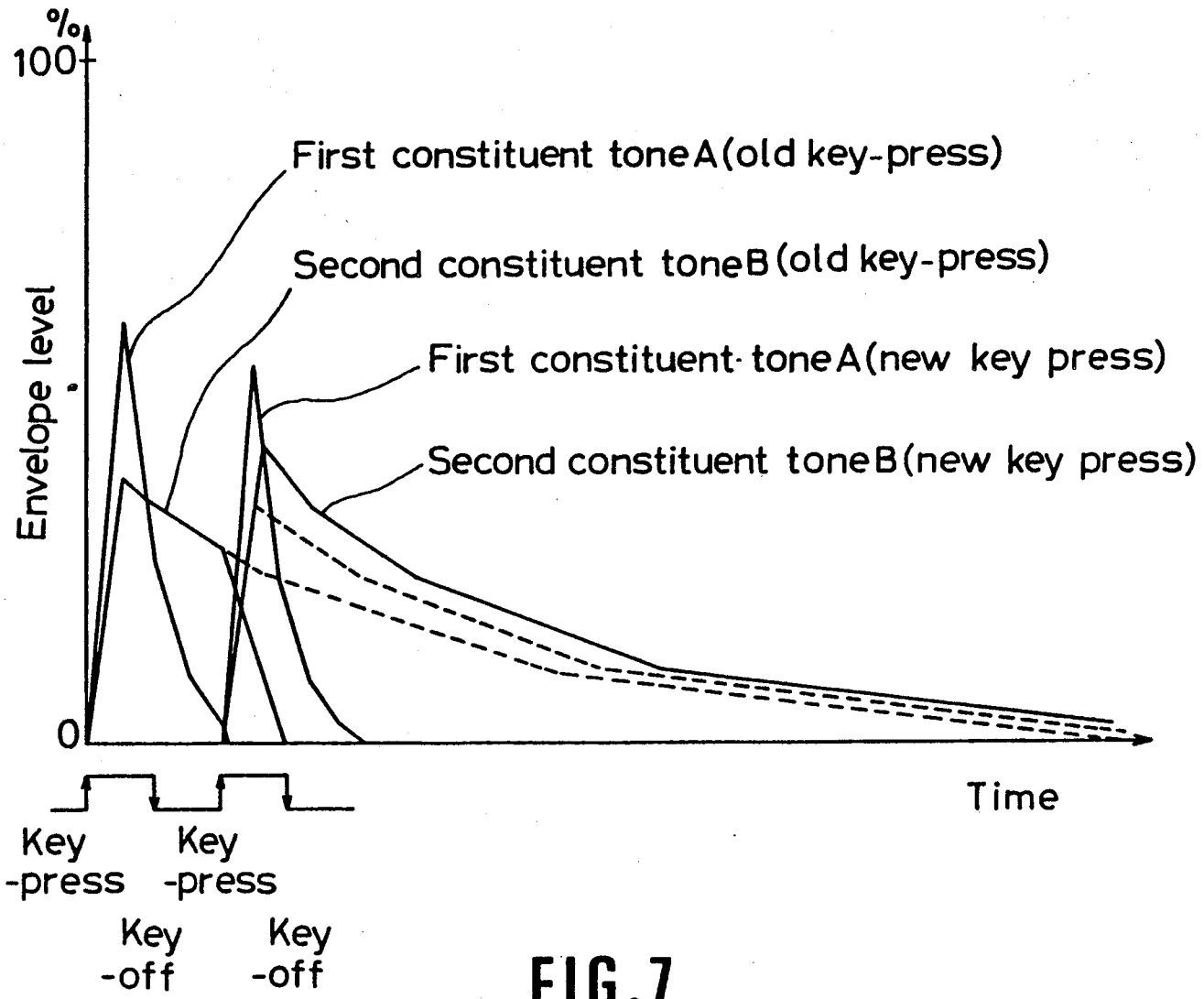
Figure 8:
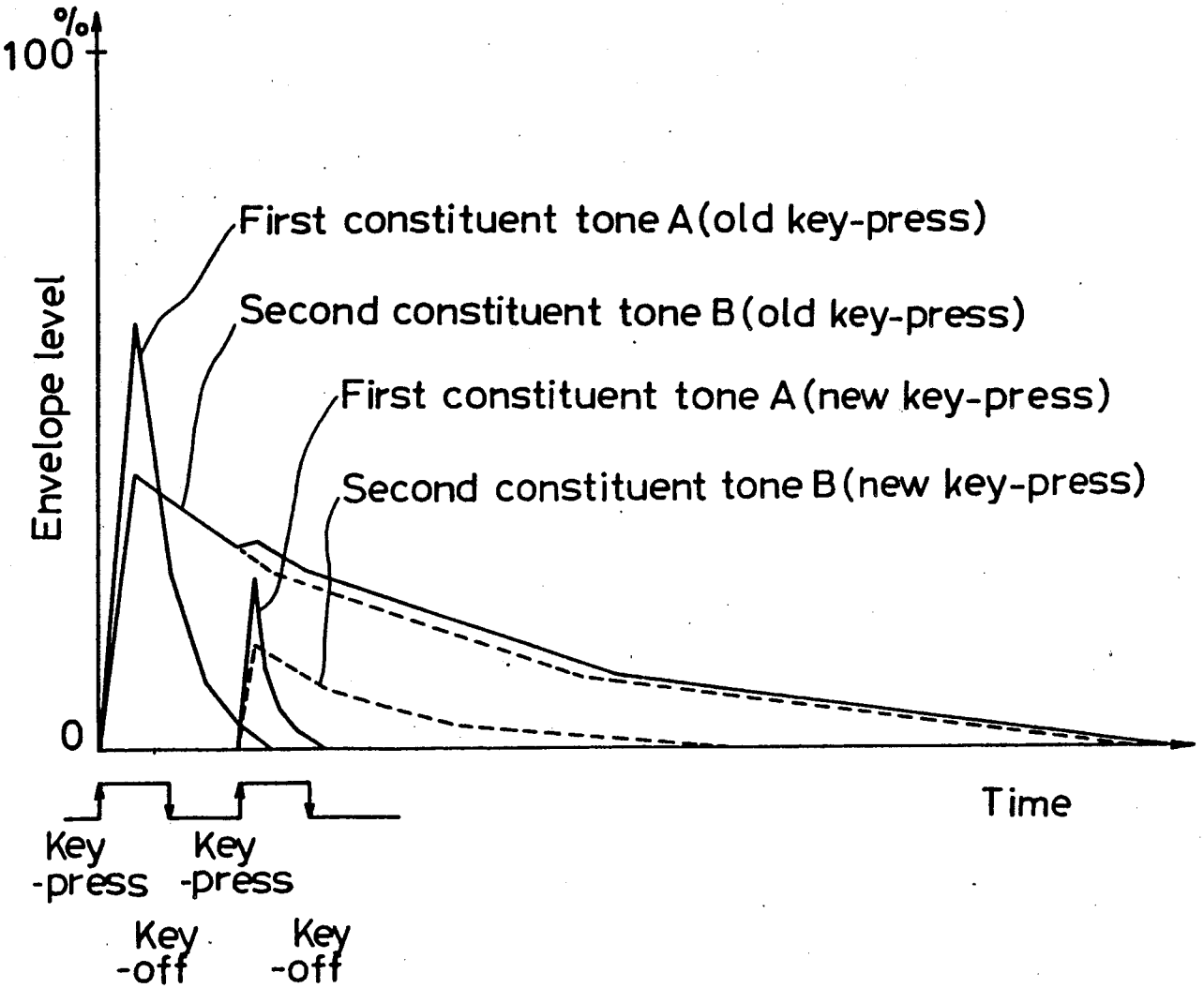
Figure 9:
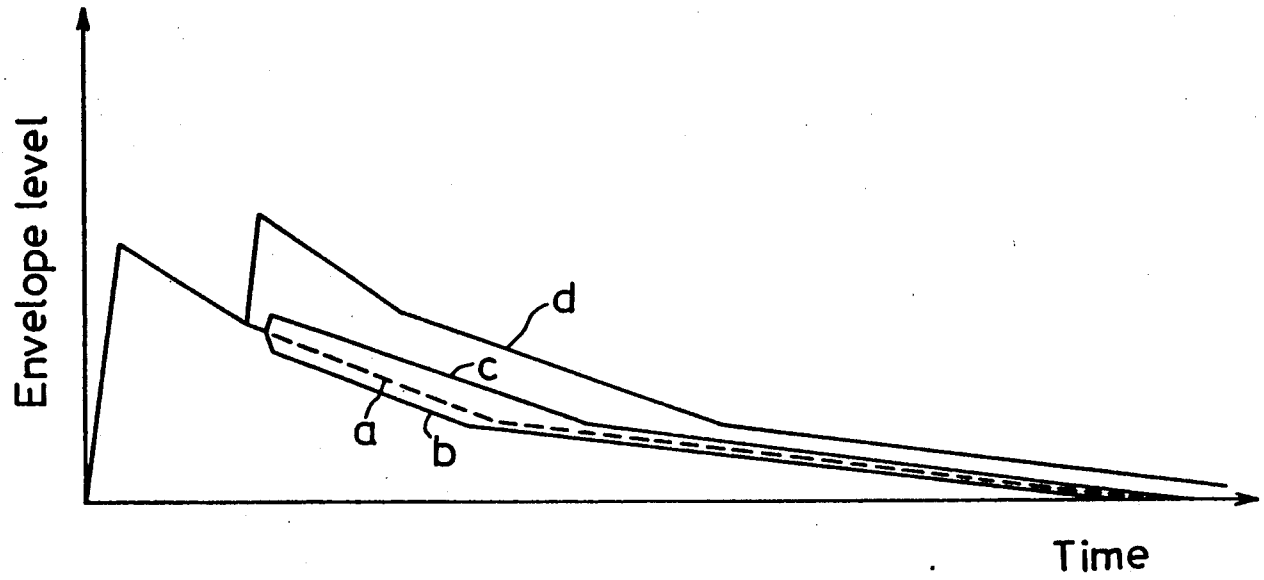
Figure 10:
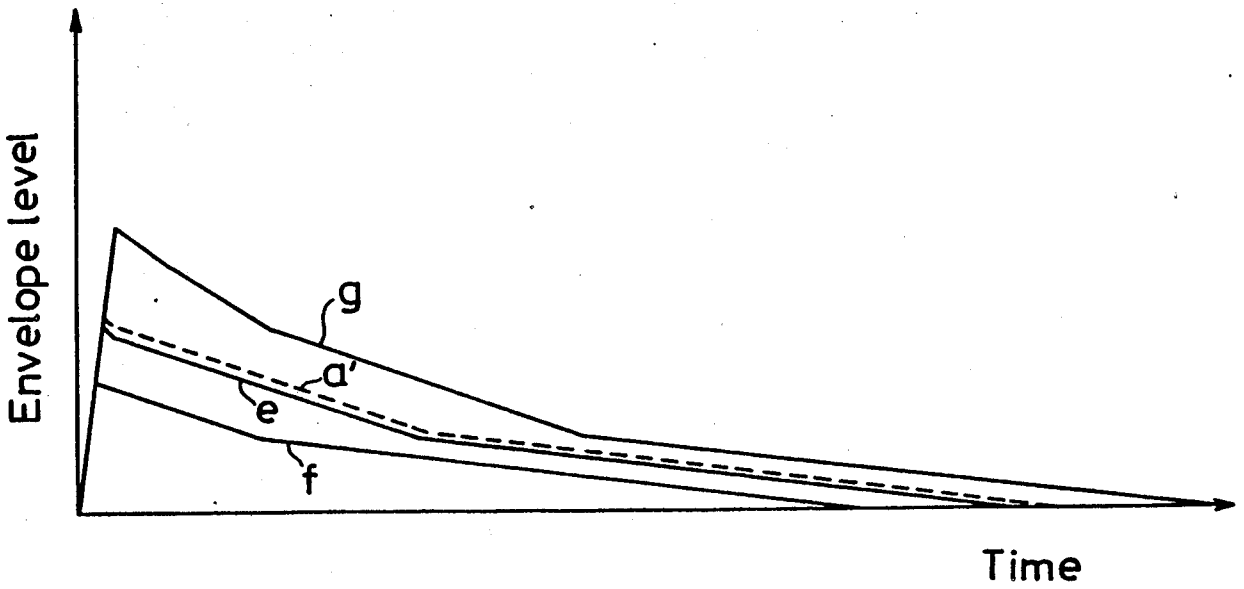

In accordance with the embodiment, when the same key is pressed consecutively and the generated volume WNL of the second constituent tone B of the new key-press is greater, a tone is generated as shown in FIG. 7, and when the generated volume WOL of the second constituent tone B of the old key-press is greater, a tone is generated as shown in FIG. 8, and the tone which is being generated and a new tone are connected smoothly while giving a natural feeling at consecutive beats. In addition, FIG. 8 shows only one example to avoid complication of description, and FIG. 9 and FIG. 10 show various modified examples of the second constituent tone B of the old key-press (FIG. 9 relates to consecutive beats after completion of the attack part A, and "a" shows the case without consecutive beats, "b" shows the case where Steps proceed in a sequence of K-1→. . . K-5→K-6→K-11→K-14 →. . . K-19, "c" shows the case where Steps proceed in a sequence of K-1→. . . K-5→K-6 K-11→K-12→K-13 . . . →K-19, and "d" shows the case where Steps proceed in a sequence of K-1→ . . . K-5→K-6→K-7→. . . K-19. Also, FIG. 10 relates to consecutive beats before completion of the attack part A, and "a'" shows the case without consecutive beats, "e" shows the case where Steps proceed in a sequence of K-1→. . . K-5→K-6→K-11→K-14→. . . K-19, "f" shows the case where Steps proceed in a sequence of K-1→. . . K-5→K-6→K-11→K-12→K-7→. . . K-19, and "g" shows the case where Steps proceed in a sequence of K-1→. . . K-5→K-6→K-7→. . . K-19.). Also, the rectangular waveforms as shown respectively at the lower parts of FIG. 7 and FIG. 8 show the pressed state and the off state of the old key-press and the new key-press against the same key.

Figure 11:
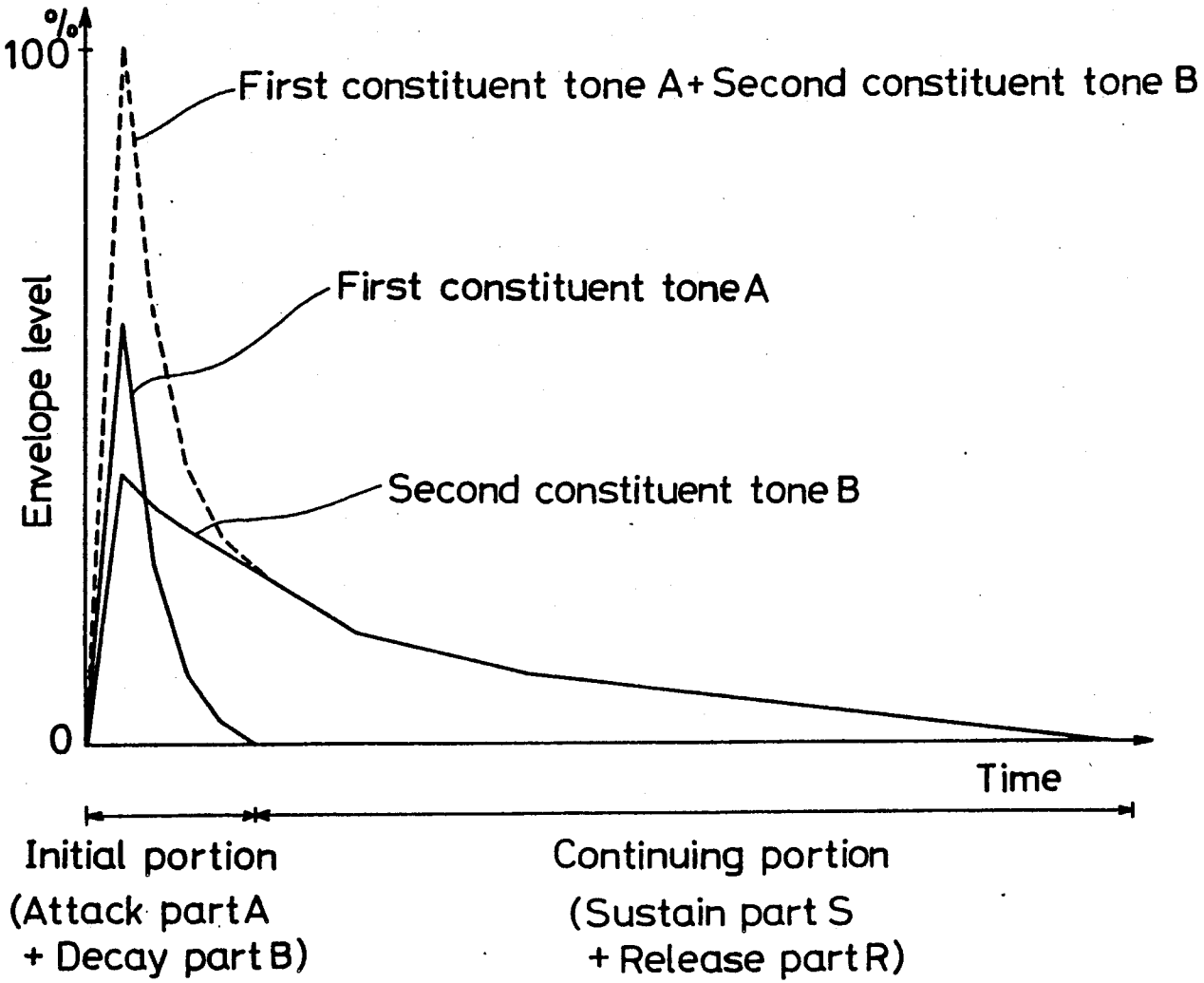

The envelope waveform of the musical tone generated becomes a composite waveform of the envelope waveform of the first constituent tone A and the envelope waveform of the second constituent tone B as shown in an envelope waveform graph in FIG. 11. As is obvious from FIG. 12 representing those waveforms respectively in a logarithmic representation, as to the second constituent tone B, the amounts of changing in the envelope per predetermined time in the envelope waveforms after the decay part D become nearly the same, and in the same key, the envelope waveforms after the decay part D of the second constituent B are regarded as similar shapes.

Figure 12:
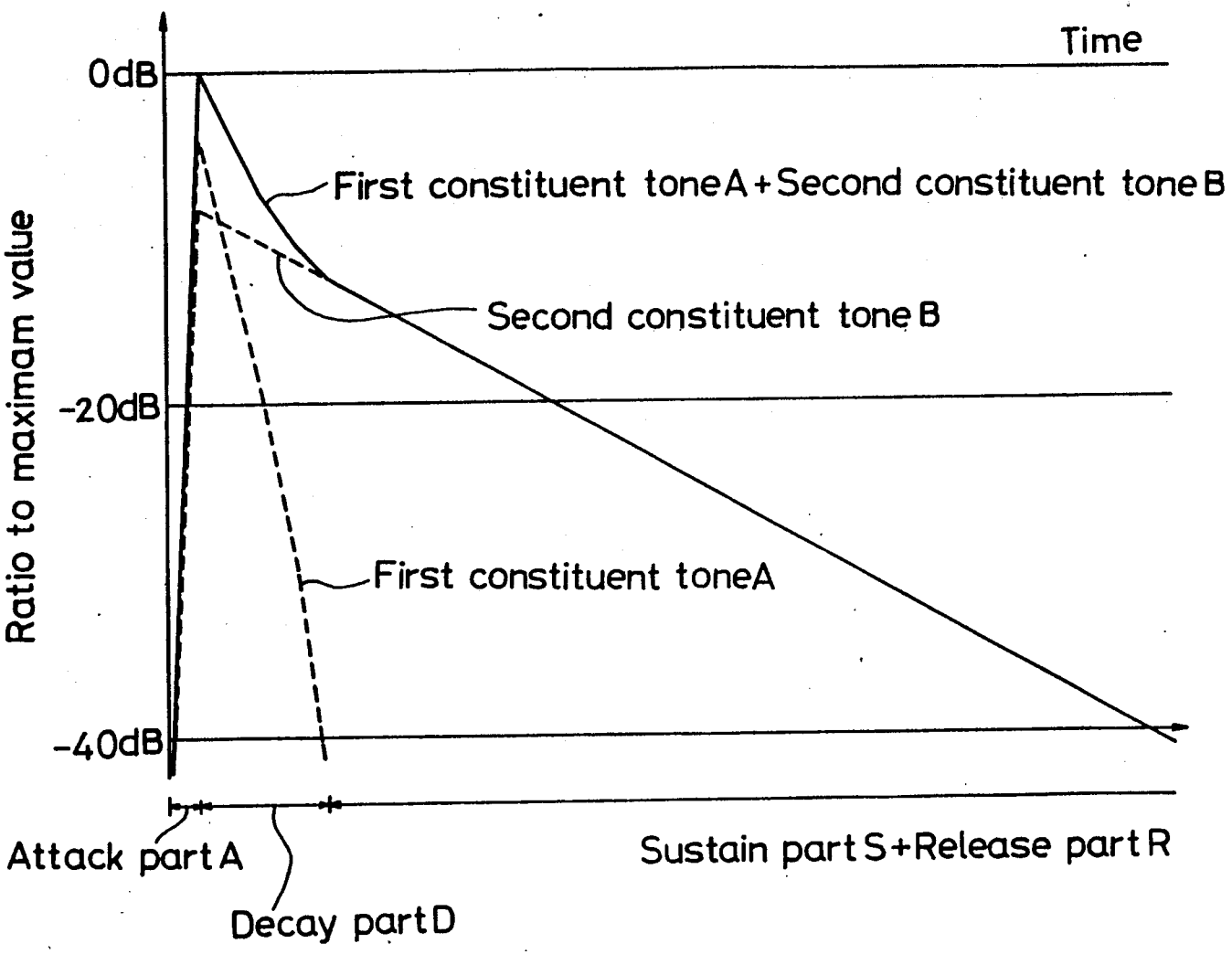

In the embodiment, the musical tone generating channels are formed in a combined manner, and the first constituent tone A and the second constituent tone B are assigned to the combination of musical tone generating channels, but the musical tone generating channel whereto the first constituent tone A is assigned is released earlier than the musical tone generating channel whereto the second constituent tone B is assigned as is obvious from FIG. 12, and therefore by performing an assigning processing separately without forming combinations, the musical tone generating channels can be effectively utilized.

Modified examples of the embodiment will be explained.

Figure 13:
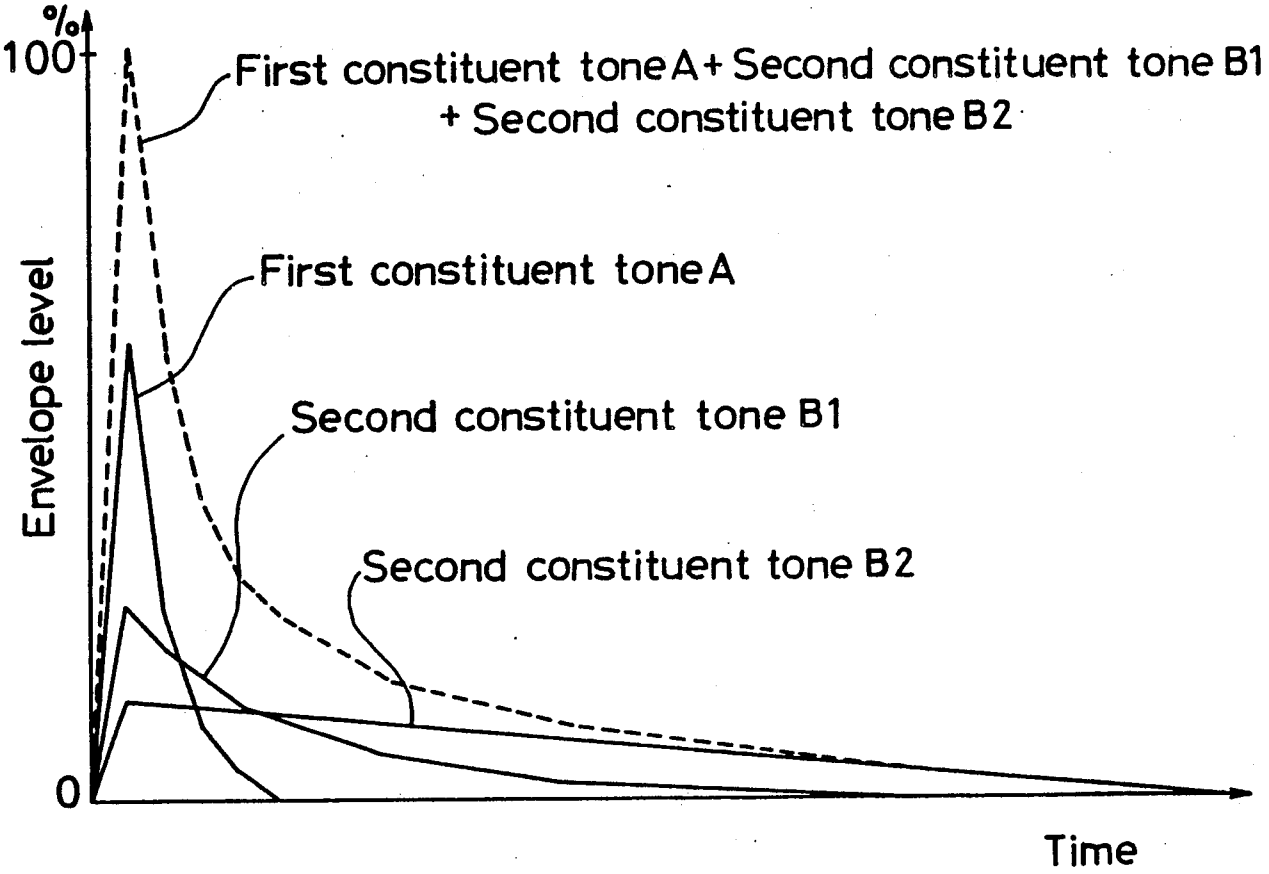

A modified example of the case where, to make the change in tone quality of the continuing portion of the musical tone generated further plentiful, in constituting the continuing portion with a plurality of second constituent tones B, for example, as shown in FIG. 13, this portion is constituted with a second constituent tone B1 wherein higher harmonic components of the continuing portion at a strong beat have a relatively high volume and the envelope is relatively short and a second constituent tone B2 wherein higher harmonic components of the continuing portion at a weak beat have relatively lesser volume and the envelope is relatively long, will be explained.

Figure 14:
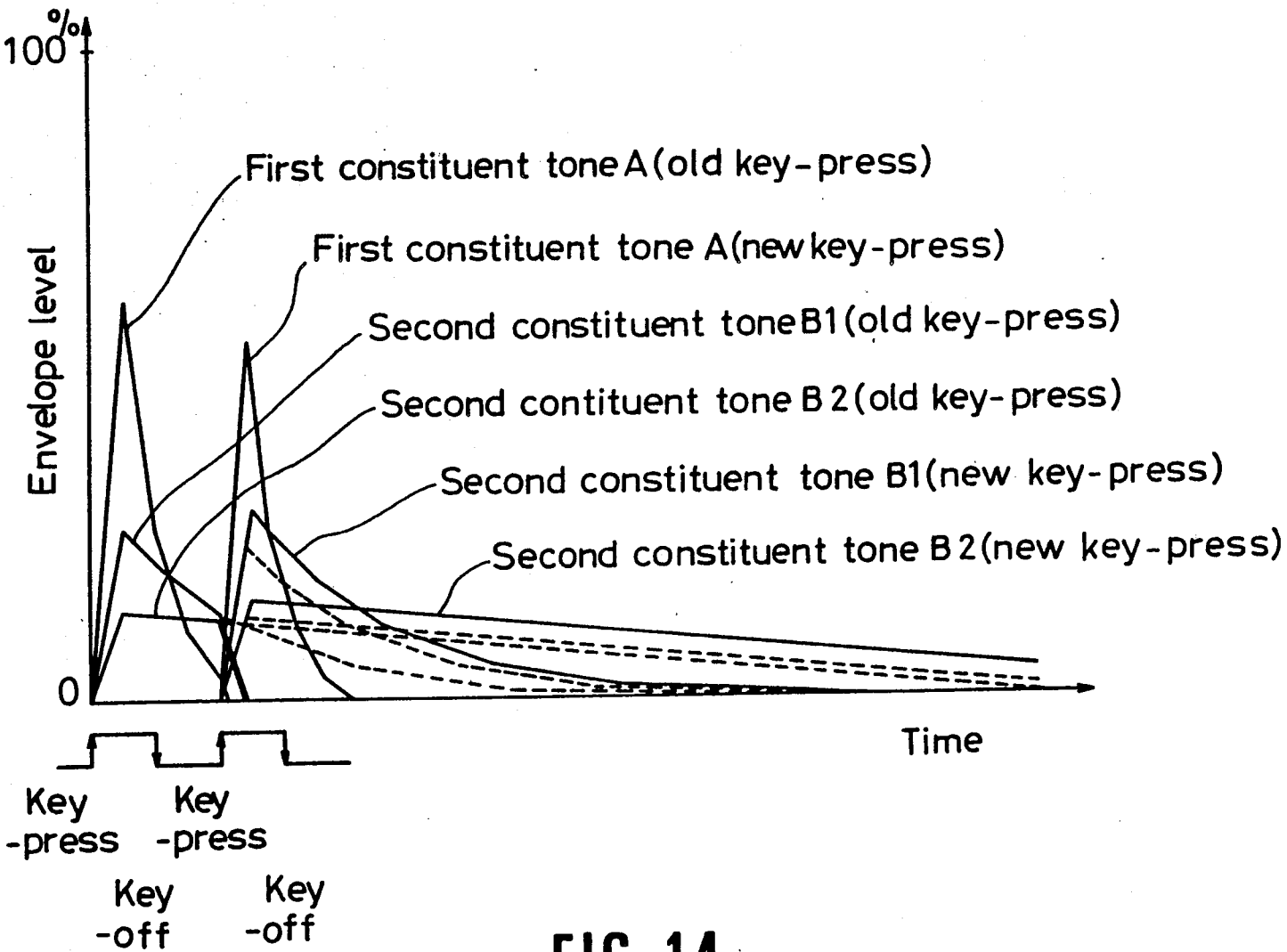
Figure 15:
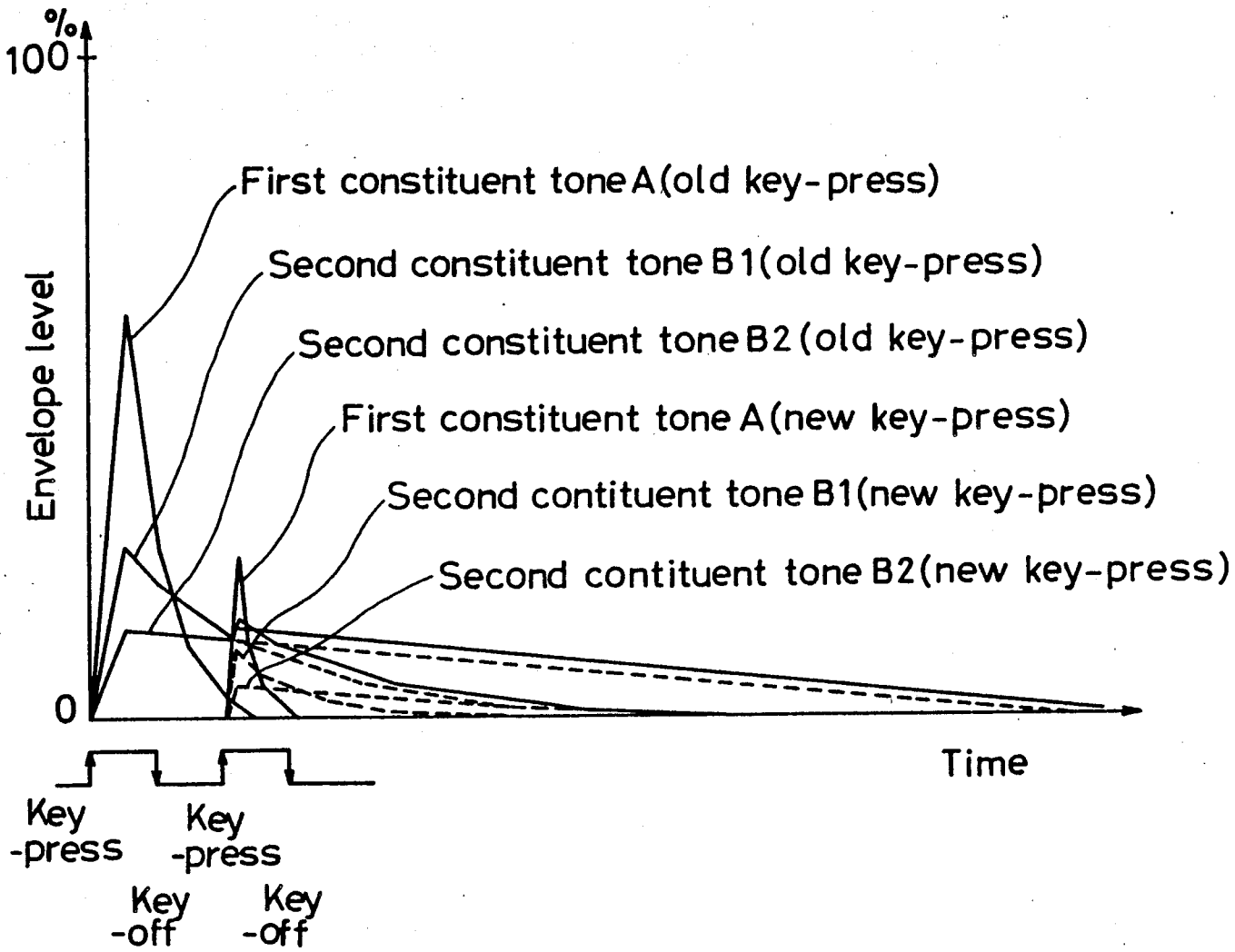

In the modified example, the musical tone generating circuit 29 is constituted with 48 musical tone generating channels from a first channel to a 48th channel, and the first channel to the third channel, the fourth channel to the sixth channel, . . . , the 46th channel to the 48th the channel form combinations generating desired musical tones, respectively. Also, the second constituent tone B2 is assigned to the first channel, the fourth channel, . . . , the second constituent tone B is assigned to the second channel, the fifth channel, . . . , and the first constituent tone A is assigned to the third channel, the sixth channel . . . , respectively, to produce a musical tone signal. Thus, based on the second constituent tone B2 having a relatively long envelope, detection of consecutive beats is performed by searching for the musical tone generating channel generating an effective tone of the same key, and change of the envelope is performed based on the sum of the generated volumes of the second constituent tone B1 and the second constituent tone B2, and thereby the key-press generating relatively high volume in the sum of generated volumes is given priority and the musical tone generating channel whereto the key-press generating relatively low volume in the sum of generated volumes is assigned is released. The other basic operations are similar to the embodiment as described above. FIG. 14 and FIG. 15 are waveform graphs showing envelopes of generation of the musical tones of the modified example corresponding to FIG. 7 and FIG. 8 of the embodiment. A second embodiment:

An embodiment in the case where a new key-press is assigned intact without performing any changing processing, and a changing processing of the envelope is performed only for the old key-press, will be described. In addition, the same symbols as those in the first embodiment show the same contents, and only portions differing particularly from the first embodiment will be described, and the duplicate portions are omitted.

In the embodiment, since a muting processing for the old key-presses is not performed, a plurality of musical tone generating channels generating an effective tone can take place and therefore a changing processing of the envelope is performed by detecting all of old key-presses for the purpose of changing the envelope.

Figure 3:
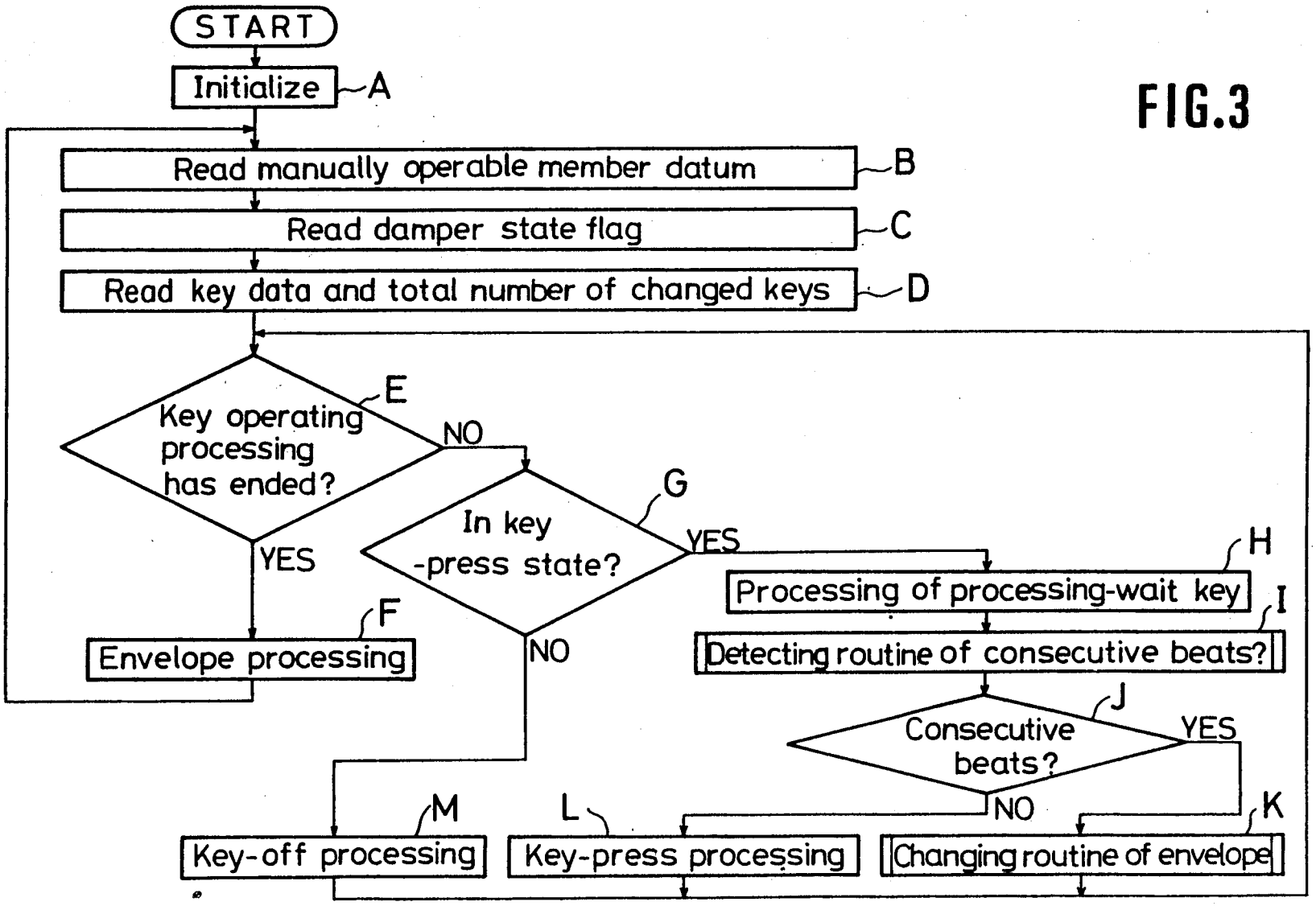

The flow-chart of the basic program in the embodiment is similar to the flow-chart of the basic program as shown in FIG. 3 of the first embodiment.

Figure 16:
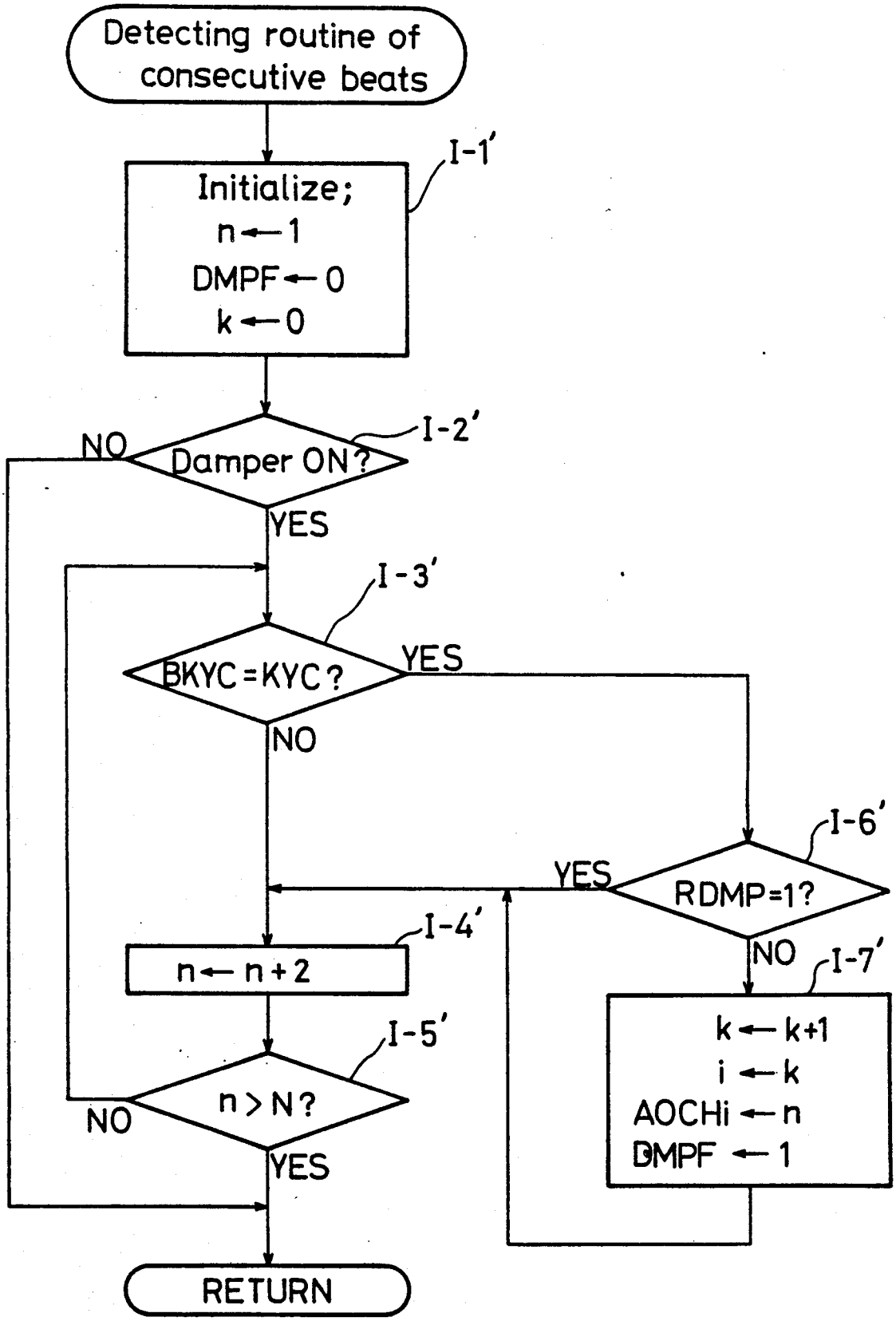

Also, a detecting routine of consecutive beats in the embodiment is shown in FIG. 16, and, in comparison with the detecting routine of consecutive beats as shown in FIG. 5 of the first embodiment, Step I-2' to Step I-6' correspond to and are the same as Step I-2 to Step I-6 of the first embodiment respectively, and Step I-1' and Step I-7' are as follows.

I-1'. The difference from Step I-1 is that, in addition to the processing of Step I-1, a total number k of the old key-presses which becomes an object of changing the envelope to be written to a register kR is initialized to "0".

I-7'. Differences from Step I-7 are as follows,

1) "1" is added to the total number k of the old key-presses, and the number after the addition is written to the register kR as a new total number k of the old key-presses.
2) The new total number k of the old key-presses is written as a number i to a register iR whereto the number i is written which shows the old key-press assigned to a i-th musical tone generating channel out of a plurality of musical tone generating channels whereto the old key-press is assigned among the old key-presses possible to exist in a plural number.

Subsequently, in place of writing the number of loops n representing the channel number of the old key-press as the old key-press of the same key previously pressed which is in a suitable consecutive beats relation thereto to the register AOCHR as the channel number AOCH of the old key-press, 3) as the old Key-press the number of loops n representing the channel number of the old key-press is written to a register AOCHiR as a channel number AOCHi of the i-th old key-press relating to a plurality of musical tone generating channels whereto the old key-press is assigned, and further,
4) processing returns to Step I-4'.

Figure 17:
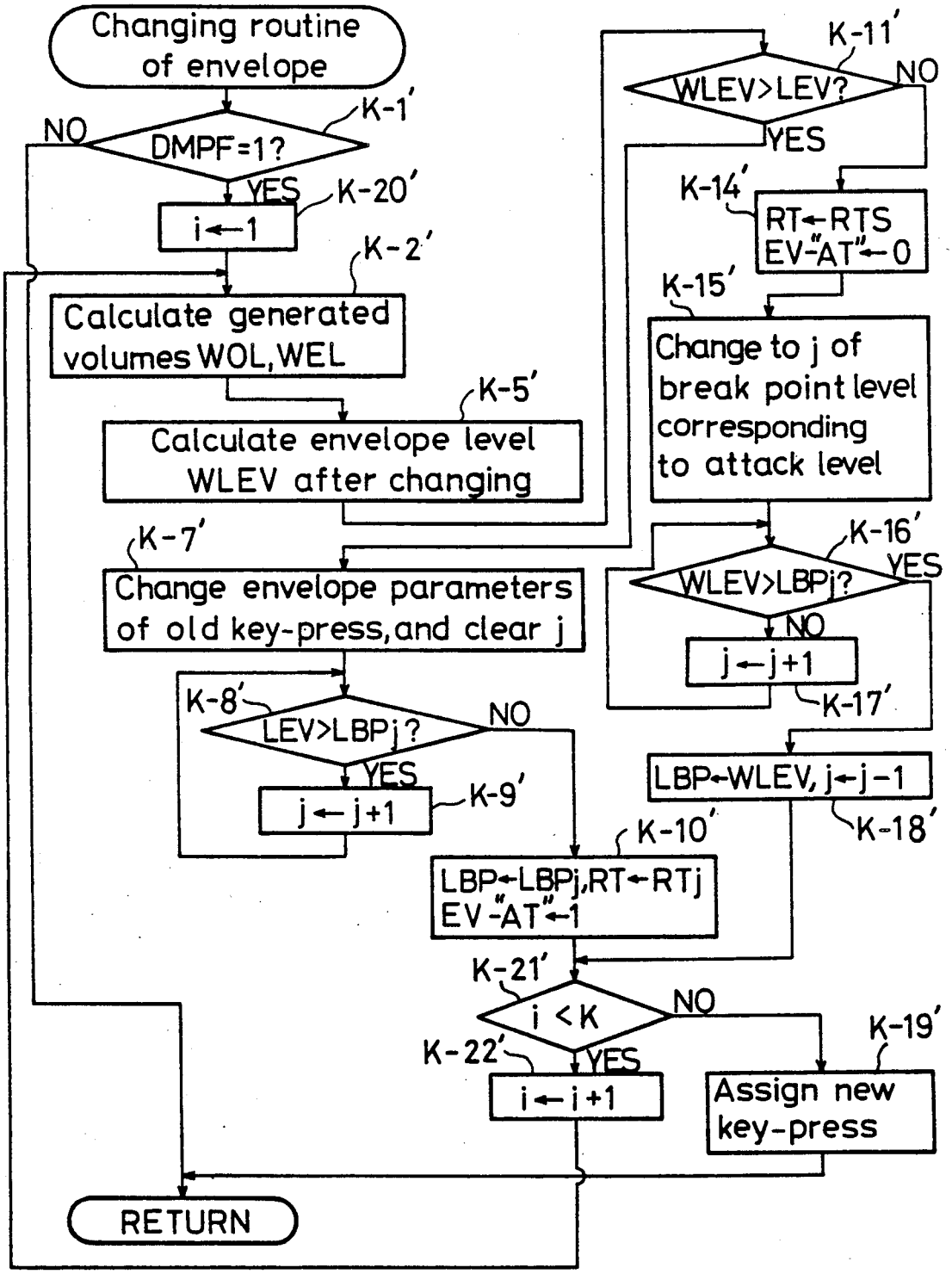

The changing routine (Step K') of an envelope will be described in detail on a step basis in reference to FIG. 17. In addition, the musical tone generating channel whereto the second constituent tone B of the old key-press to be processed in the changing routine of an envelope (Step K') is assigned is the musical tone generating channel of the channel number of the old key-press which is detected in the detecting routine of consecutive beats (Step I'), being written to the register AOCHiR.

Figure 6:
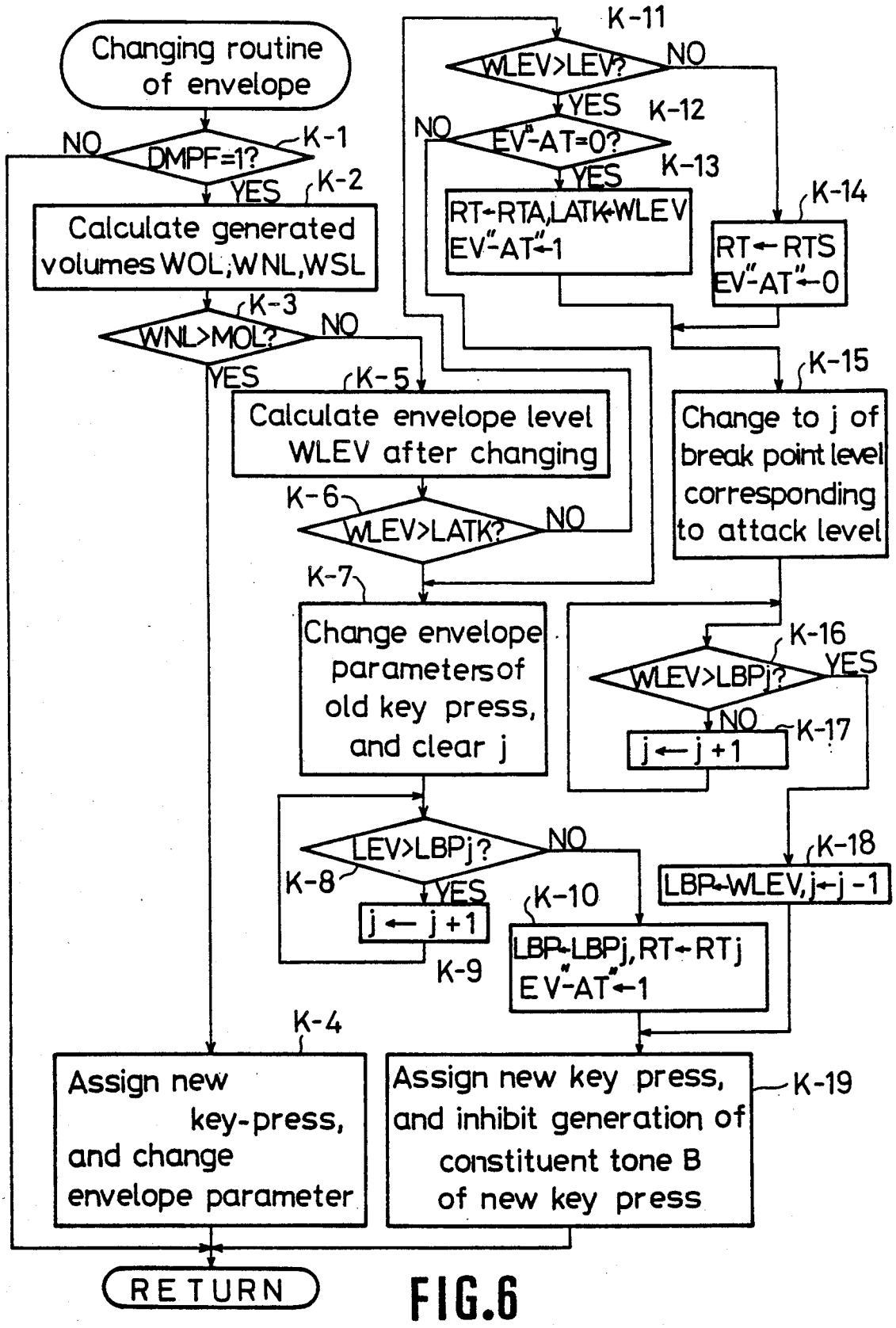

In the changing routine of an envelope in the embodiment, in comparison with the changing routine of an envelope as shown in FIG. 6 of the first embodiment, Step K-1', Step K-7' to Step K-11' and Step K-14' to Step K-18' correspond respectively to and are the same as Step K-1, Step K-7 to Step K-11, and Step K-14 to Step K-18 of the first embodiment, and Steps K-3, K-4, K-6, K-12 and K-13 are deleted, and the changed Steps K-2', K-5' and K-19' and Steps K-20', K-21' and K-22' added to process a plurality of old key-presses are as follows.

The difference of Step K-2' from Step K-2 is as follows.

1) Calculation of the generated volume WNL of the second constituent tone B to be generated by the new key-press is not performed.

2) calculation of the generated volume WOL of the second constituent tone B to be generated by the old key-press is performed, and
3) in place of calculation of the composite generated volume WSL of the second constitute tone B, calculation of a remaining generated volume WEL of the second constituent tone B of the old key-press is performed.

This remaining generated volume WEL of the second constituent tone B of the old key-press is evaluated by multiplying the generated volume WOL of the second constituent tone B to be generated by the old key-press by the remaining factor KD.

WEL=KD x WOL

K- 5'. The difference from Step K-5 is that in place of the composite generated volume WSL of the second constituent tone B in Step K-5, the remaining generated volume WEL of the second constituent tone B of the old key-press is used.

K-19'. The difference from Step K-19 is to perform an assigning processing of the new key-press without performing the processing of "generating no second constituent tone B of the new key-press" in Step K-19.

K-20'. The number of loops i to be written to the register iR is initialized to "1", and the musical tone generating channel whereto the second constituent tone B of the old key-press to be processed is assigned is applied for the musical tone generating channel of the channel number of the old key-press written to a register AOCHIR (AOCHiR, i=1) in place of the musical tone generating channel of the channel number of the old key-press written to the register AOCHR in the first embodiment.

K-21'. Decision is made on whether or not the number i which is written to the register iR and shows the old key-press assigned to the i-th musical tone generating channel among a plurality of musical tone generating channels whereto the old key-press is assigned is smaller than the total number k of the old key-presses written to the register kR. Where the number i showing the number of the musical tone generating channel whereto the old key-press is assigned is not smaller than the total number k of old key-presses, go to Step K-19'.

K-22'. Where the number i showing the old key-press assigned to the i-th musical tone generating channel is smaller than the total number k of old key-presses in the decision in Step K-21', a processing of all old key-presses has not been completed, and therefore "1" is added to the number i showing the old key-press assigned to the i-th musical tone generating channel to process the next old key-press, and the number after the addition is written to the register iR as a new number i showing the number of the musical tone generating channel whereto the old key-press is assigned, and the musical tone generating channel whereto the second constituent tone B of the old key-press to be processed is assigned is applied to the musical tone generating channel of the channel number of the old key-press written to the register AOCHiR corresponding to the number i showing the old key-press assigned to a new i-th musical tone generating channel in place of the musical tone generating channel of the channel number of the old key-press written to the register AOCHR in the first embodiment. Next, return to Step K-2'.

In the embodiment, the modified examples of the first embodiment are also applicable.

Other modified examples of the embodiment will be explained.

Modified example 1

A modified example where a musical tone to be generated is generated from one musical tone generating channel as one composite musical tone without dividing the tone into the first constituent tone A and the second constituent tone B as described above will be described.

In an envelope waveform graph in FIG. 11, the envelope waveform of a musical tone generated becomes a composite waveform of an envelope waveform of the first constituent tone A and an envelope waveform of the second constituent tone B.

The difference from the embodiment is that "1" is added to the number of loops n in place of adding "2" thereto in Step 1-4' of the detecting routine of consecutive beats.

Also, another difference is that in Step K-2' of the changing routine of an envelope, the generated volume WOL of the second constituent tone B to be generated by the old key-press is evaluated by adding the envelope level of the first constituent tone A obtained from the envelope level LEV of a musical tone (composite tone) generated by a conversion table or the like corresponding to the envelope waveform graph in FIG. 11 and the value evaluated by multiplying the envelope level of the second constituent tone B obtained from the envelope level of a musical tone (composite tone) generated by a conversion table or the like corresponding to the envelope waveform graph in FIG. 11 in the same way by the remaining factor KD.

As a simple processing, the generated volume WOL of the second constituent tone B to be generated by the old key-press may be replaced with the envelope level LEV of the musical tone (composite tone) generated.

Modified example 2

Another modified example wherein to obtain the change in tone quality of the continuing portion and to reduce the number of constituent tones, the tone of the initial portion and the tone of the continuing portion are contained at different ratios in the first constituent tone A and the second constituent tone B instead of constituting a musical tone generated with the first constituent tone A and second constituent tone B will be described.

Figure 18:
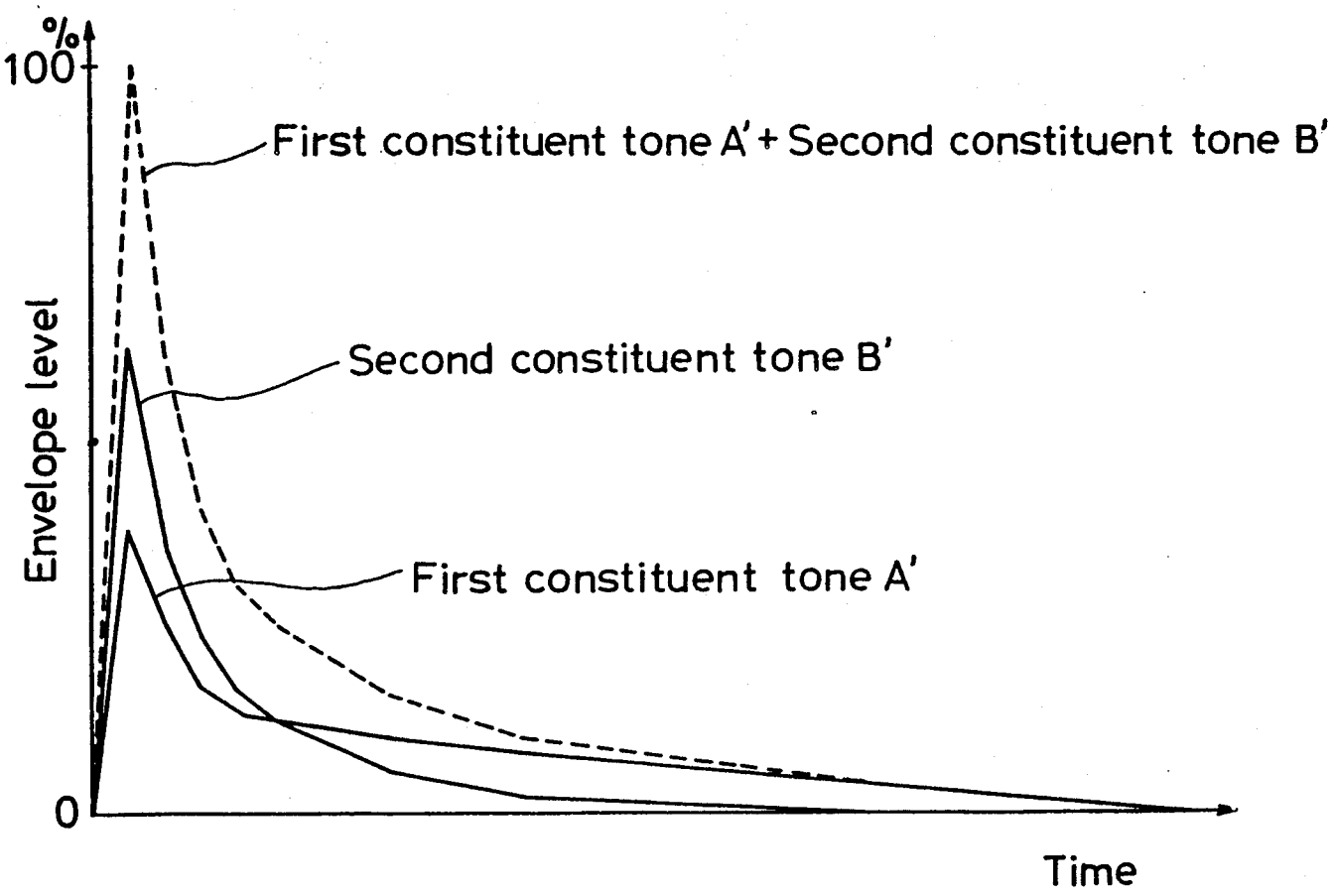
Figure 19:
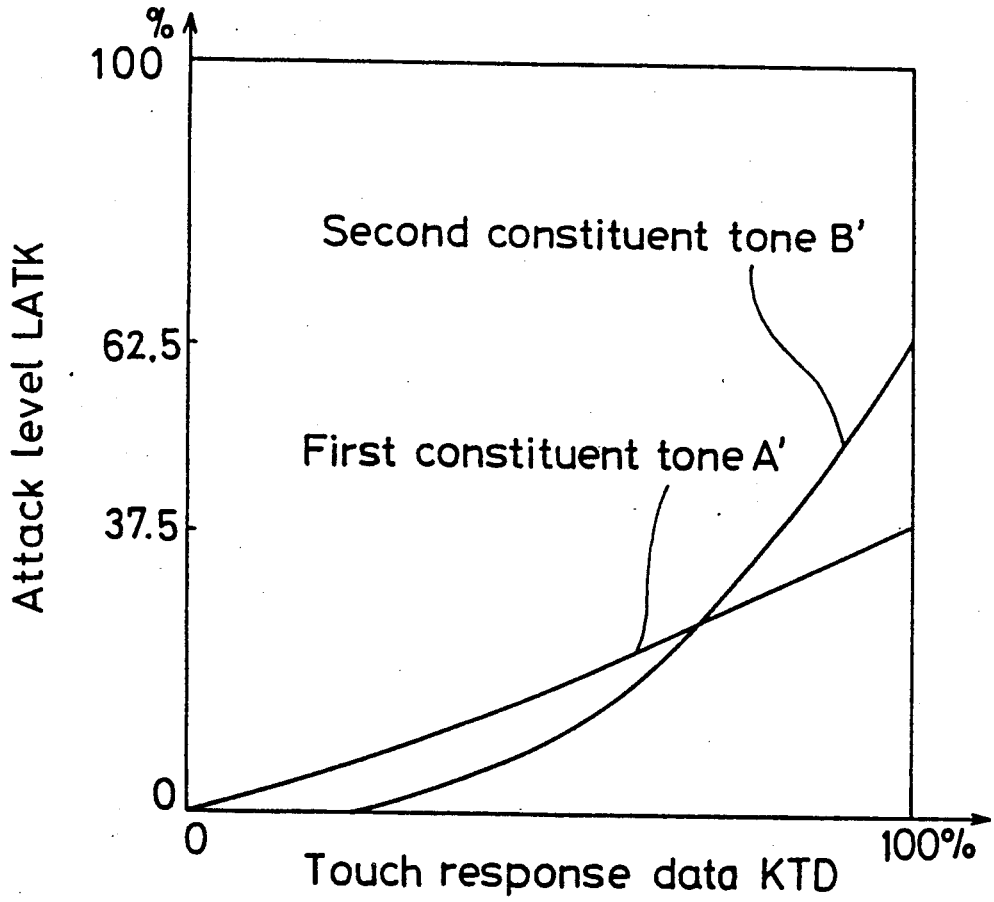

A musical tone generated as shown in FIG. 18 consists of a first constituent tone A' which is not varied excessively in tone quality by the strength of touch and constitutes mainly the initial portion of a weak key-press which provides a lesser number of higher harmonic conponents and gives a round feeling and a second constituent tone B' which is generated as a result of a strong touch and constitutes mainly the continuing portion of a strong key-press which, in the case of a piano, contains a greater number of higher harmonic components and gives a hard feeling. Then, FIG. 19 shows touch response data KTD-attack level LATK conversion table showing a relationship between the touch response datum KTD and the attack level LATK which is equivalent to FIG. 4 as described above. Accordingly, at a weak key-press, the second constituent tone B' is not generated, and the first constituent tone A' dominates the musical tone.

In addition, the difference from the embodiment is that in Step K-2' of the changing routine of an envelope, the generated volume WOL to be generated by the old key-press is evaluated by adding the generated volumes of the first constituent tone A' and the second constituent tone B', respectively.

In the modified example 1 and the modified example 2, the ratio of constituent tones is changed, and therefore the tone quality may be changed. Also, the modified example 1 and the modified example 2 may be applied to the first embodiment.

All of the registers used in each embodiment are installed in areas assigned imaginally to the RAM21C of the micro-computer 21 as described above.

It is needless to say that the present invention is applicable to the processing in the case where the musical tone generated by the so-called key switch or the like is generated in a superposed manner in an electronic drum apparatus, rhythm machine or the like. Also, in that case, it is also possible that, to enhance the performability, for example, by performing quick consecutive beats, the same musical tone is assigned to two or more key switches or the like, and the same musical tone is generated by alternately operating these switches or the like.

Furthermore, in a performing apparatus such as a rhythm machine or an automatic accompanying apparatus which can store or program a performance, automatically perform or automatically accompany or the like, the present invention is appplicable also where the same musical tone is generated in a superposed manner by means of read-converting key-press/off information(s) generated by key-press/off a operation of the embodiment into key-press/off information(s) generated in such a performing apparatus or information(s) equivalent thereto and changing the other processings peculiar to the performing apparatus so as to correspond thereto.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electronic musical instrument having musical tone generating channels, said instrument comprising:

a first detecting means for detecting whether or not a first musical tone which is assigned to be generated by one of said musical tone generating channels is the same as a second musical tone which already has been assigned to be generated by one of said musical tone generating channels and is being generated thereby, a second detecting means for detecting a volume for said first musical tone and a volume of said second musical tone when said first musical tone is to be generated, a calculating means for calculating a composite tone volume based on said volume for said first musical tone and said volume of said second musical tone which are detected by said second detecting means, a changing means, responsive to a detection by said first detecting means that said first and second musical tones are the same, for changing the volume of one of said first musical tone or said second musical tone to said composite tone volume calculated by said calculating means, said one of said first or second musical tones having its volume changed to said composite tone volume being a preferential tone of said instrument, and the other of said musical tones being a nonpreferential tone thereof, and releasing means for releasing said musical tone generating channel assigned to generate said nonpreferential tone.

2. An electronic musical instrument as claimed in claim 1, wherein said second detecting means detects said volume for said first musical tone and said second musical tone volume based on a constituent tone mainly providing a continuing portion of said first and second musical tones.

3. An electronic musical instrument as claimed in claim 1, wherein a composite volume WSL is given by the following equation $$WSL = \sqrt{(KD \times WOL)^2 + (WNL)^2}$$

where KD is a factor providing a reduced volume for said second musical tone when said first musical tone is generated, WNL is said volume for said first musical tone, and WOL is said volume of said second musical tone when said first musical tone is to be generated.

4. An electronic musical instrument as claimed in claim 1, wherein said changing means changes an envelope of said preferential musical tone and thereby changes the volume of said preferential musical tone to said composite tone volume.

5. An electronic musical instrument as claimed in claim 4, further comprising a releasing means which changes said envelope of said nonpreferential musical tone and thereby quickly releases said musical tone generating channel assigned to generate said nonpreferential tone.

6. An electronic musical instrument as claimed in claim 5, wherein said nonpreferential musical tone is said first musical tone, said releasing means suppressing generation of a constituent tone mainly providing a continuing portion of said first musical tone.

7. An electronic musical instrument having musical tone generating channels, said instrument comprising:

a first detecting means for detecting whether or not a first musical tone which is to be generated by one of said musical tone generating channels is the same as a second musical tone which already has been generated by another of said musical tone generating channels, a second detecting means for detecting a volume of said second musical tone when said first musical tone is to be generated, a calculating means for calculating a remainder volume WEL based on said volume detected by said second detecting means, said remainder volume WEL being calculated according to the following equation $$WEL = KD \times WOL$$

where KD is a factor providing a reduced volume for said second musical tone when said first musical tone is generated, and WOL is said volume of said second musical tone, and a changing means, responsive to a detection by said first detecting means that said first and second musical tones are the same, for changing the volume of said second musical tone generated by said another of said musical tone generating channels to said remainder volume WEL calculated by said calculating means.

8. An electronic musical instrument as claimed in claim 7, wherein said second detecting means detects said second musical tone volume based on a constituent tone mainly providing a continuing portion of said second musical tone.

9. An electronic musical instrument as claimed in claim 7, wherein said changing means changes an envelope of said second musical tone, and thereby changes said volume of said second musical tone to said remainder volume.

10. An electronic musical instrument as claimed in claim 1 or claim 7, wherein said electronic musical instrument is an electronic keyboard musical instrument, an electronic drum apparatus, a rhythm machine, an automatic performing apparatus, or an automatic accompanying apparatus.

11. An electronic musical instrument as claimed in claim 1 or claim 7, wherein said second detecting means detects said second musical tone volume by simulating an envelope waveform of said second musical tone.

12. An electronic musical instrument as claimed in claim 1 or claim 7, wherein said second detecting means detects said second musical tone volume from an envelope level of said second musical tone.

13. An electronic musical instrument as claimed in claim 3 or claim 7 wherein said factor is a value corresponding to musical tone intensity, the interval between said first and second musical tones, musical tone pitch, and musical tone quality.

14. An electronic musical instrument as claimed in claim 13, wherein said factor is a value to which a random value is further added.

15. An electronic musical instrument as claimed in claim 13, wherein said factor further corresponds to a number of musical tone higher harmonics.

16. An electronic musical instrument having musical tone generating channels, said instrument comprising:

a first detecting means for detecting whether or not a first musical tone which is assigned to be generated by one of said musical tone generating channels in response to a new key-press and a second musical tone which already has been assigned to be generated by one of said musical tone generating channels and is being generated thereby in response to a previous key-press are consecutive beats of the same musical tone by the same key, a second detecting means for detecting a volume for said first musical tone and a volume of said second musical tone when said first musical tone is to be generated in response to said new key-press, a calculating means for calculating a composite tone volume based on said volume of said first musical tone and said volume of said second musical tone which are detected by said second detecting means, a changing means, responsive to a detection by said first detecting means that said first and second musical tones are consecutive beats by the same key, for changing the volume of one of said first musical tone or said second musical tone to said composite volume calculated by said calculating means, said one of said first or second musical tones having its volume changed to said composite tone volume being a preferential tone of said instrument, and the other of said musical tones being a nonpreferential tone thereof, and releasing means for releasing said musical tone generating channel assigned to generate said nonpreferential tone.

17. An electronic musical instrument having musical tone generating channels, said instrument comprising:

a first detecting means for detecting whether or not a first musical tone to be generated by one of said musical tone generating channels in response to a new key-press and a second musical tone which already has been generated by another of said musical tone generating channels in response to a previous key-press are consecutive beats of the same musical tone by the same key, a second detecting means for detecting a volume of said second musical tone when said first musical tone is to be generated in response to said new key-press, a calculating means for calculating a remainder volume WEL based on said volume detected by said second detecting means, said remainder volume WEL being calculated according to the following equation $$WEL = KD \times WOL$$

where KD is a factor providing a reduced volume for said second musical tone when said first musical tone is generated, and WOL is said volume of said second musical tone, and a changing means, responsive to a detection by said first detecting means that said first and second musical tones are consecutive beats by the same key, for changing the volume of said second musical tone to said remainder volume.

18. An electronic musical instrument having musical tone generating channels, said instrument comprising:

a first detecting means for detecting whether or not a first musical tone to be generated by one of said musical tone generating channels is the same as a second musical tone which already has been generated by another of said musical tone generating channels, a second detecting means for detecting a value representative of a volume of said second musical tone at a time when said first musical tone is to be generated, a calculating means for calculating a remainder volume value WEL based on said volume value detected by said second detecting means, said remainder volume WEL being calculated according to the following equation $$WEL = KD \times WOL$$

where KD is a factor providing a reduced volume for said second musical tone when said first musical tone is generated, and WOL is aid volume of said second musical tone, and a changing means, responsive to a detection by said first detecting means that said first and second musical tones are the same, for changing the volume of said second musical tone generated by said another of said musical tone generating channels to a value equivalent to said remainder volume value WEL calculated by said calculating means.

19. An electronic musical instrument having musical tone generating channels, said instrument comprising:

a first detecting means for detecting whether or not a first musical tone assigned to be generated by one of said musical tone generating channels is the same as a second musical tone which already has been assigned to be generated by one of said musical tone generating channels and is being generated thereby, a second detecting means for detecting a value representative of a volume for said first musical tone and a value representative of a volume of said second musical tone at the time said first musical tone is to be generated, a calculating means for calculating a composite tone volume value based on said detected volume value for said first musical tone and said detected volume value of said second musical tone, a changing means, responsive to a detection by said first detecting means that said first and second musical tones are the same, for changing the volume of one of said first musical tone or said second musical tone to a value equivalent of said composite tone volume value calculated by said calculating means, said one of said first or second musical tones having its volume changed to said composite tone volume being a preferential tone of said instrument, and the other of said musical tones being a nonpreferential tone thereof, said releasing means for releasing said musical tone generating channel assigned to generate said nonpreferential tone.

* * * * *